US010988991B1

(12) United States Patent
McCormick

(10) Patent No.: US 10,988,991 B1
(45) Date of Patent: Apr. 27, 2021

(54) SENSOR TRANSPORTATION DEVICE

(71) Applicant: PETROMAC IP LIMITED, Auckland (NZ)

(72) Inventor: Stephen Peter McCormick, Auckland (NZ)

(73) Assignee: PETROMAC IP LIMITED, Auckland (NZ)

( * ) Notice: Subject to any disclaimer, the term of this patent is extended or adjusted under 35 U.S.C. 154(b) by 0 days.

(21) Appl. No.: 17/091,854

(22) Filed: Nov. 6, 2020

(30) Foreign Application Priority Data

Sep. 30, 2020 (NZ) ..... 768524

(51) Int. Cl.
*E21B 17/10* (2006.01)
*E21B 49/00* (2006.01)

(52) U.S. Cl.
CPC ..... *E21B 17/1021* (2013.01); *E21B 17/1057* (2013.01); *E21B 49/00* (2013.01)

(58) Field of Classification Search
CPC .. E21B 17/1021; E21B 17/1057; E21B 49/00; E21B 17/1014
See application file for complete search history.

(56) References Cited

U.S. PATENT DOCUMENTS 4,557,327 A 12/1985 Kinley et al.
4,619,322 A 10/1986 Armell et al.
5,358,040 A * 10/1994 Kinley ..... E21B 17/1021 166/241.3
5,574,263 A 11/1996 Roesner
5,971,404 A * 10/1999 Stoves ..... F16L 55/44 104/138.2
7,505,063 B1 * 3/2009 Bastedo ..... B08B 9/043 15/104.05
8,919,209 B2 12/2014 Furlong
9,863,198 B2 1/2018 McCormick
9,963,954 B2 5/2018 Al-Mulhem
2003/0145985 A1 8/2003 Stuart-Bruges
2006/0067162 A1 * 3/2006 Blankinship ..... E21B 47/005 367/35
2012/0048542 A1 3/2012 Jacob
2014/0238659 A1 8/2014 Wheater et al.
2016/0298396 A1 10/2016 Church
2019/0383108 A1 12/2019 Massey
2020/0362645 A1 11/2020 Donzier

* cited by examiner

*Primary Examiner* — Taras P Bemko
(74) *Attorney, Agent, or Firm* — Dann, Dorfman, Herrell and Skillman, P.C.

(57) ABSTRACT

A device for transporting a sensor assembly in a bore comprises a plurality of wheels azimuthally spaced apart around a longitudinal axis of the device. Each wheel presents a radial extremity of the device. The wheels are moveably supported to move between a minimum outer diameter of the device and a maximum outer diameter of the device. An adjustable stop mechanism is configured to pre-set the maximum outer diameter of the device within a range of maximum outer diameters so that the device is configurable for use in a pre-determined range of bore diameters. One or more spring elements bias the wheels radially outwards and are preloaded to provide a radial force to the wheels when at the pre-set maximum outer diameter.

20 Claims, 16 Drawing Sheets

SENSOR TRANSPORTATION DEVICE

CORRESPONDING APPLICATION

This application is based on the provisional specification filed in relation to New Zealand Patent Application Number 768524, the entire contents of which is incorporated herein by reference.

TECHNICAL FIELD

This invention relates to devices for use in transporting sensor equipment down a bore such as a pipe, a wellbore or a cased wellbore, and in particular to devices for use in transporting sensor equipment through a wellbore during wireline logging operations while maintaining the sensor equipment near to a centreline of the wellbore.

BACKGROUND

Hydrocarbon exploration and development activities rely on information derived from sensors which capture data relating to the geological properties of an area under exploration. One approach used to acquire this data is through wireline logging. Wireline logging is performed in a wellbore immediately after a new section of hole has been drilled, referred to as open-hole logging. These wellbores are drilled to a target depth covering a zone of interest, typically between 1000-5000 meters deep. A sensor package, also known as a "logging tool" or "tool-string" is then lowered into the wellbore and descends under gravity to the target depth of the wellbore well. The logging tool is lowered on a wireline—being a collection of electrical communication wires which are sheathed in a steel cable connected to the logging tool. The steel cable carries the loads from the tool-string, the cable itself, friction forces acting on the downhole equipment and any overpulls created by sticking or jamming. Once the logging tool reaches the target depth it is then drawn back up through the wellbore at a controlled rate of ascent, with the sensors in the logging tool operating to generate and capture geological data.

Wireline logging is also performed in wellbores that are lined with steel pipe or casing, referred to as cased-hole logging. After a section of wellbore is drilled, casing is lowered into the wellbore and cemented in place. The cement is placed in the annulus between the casing and the wellbore wall to ensure isolation between layers of permeable rock layers intersected by the wellbore at various depths. The cement also prevents the flow of hydrocarbons in the annulus between the casing and the wellbore which is important for well integrity and safety. Oil wells are typically drilled in sequential sections. The wellbore is "spudded" with a large diameter drilling bit to drill the first section. The first section of casing is called the conductor pipe. The conductor pipe is cemented into the new wellbore and secured to a surface well head. A smaller drill bit passes through the conductor pipe and drills the surface hole to a deeper level. A surface casing string is then run in hole to the bottom of the hole. This surface casing, commonly 20" (nominal OD) is then cemented in place by filling the annulus formed between the surface casing and the new hole and conductor casing. Drilling continues for the next interval with a smaller bit size. Similarly, intermediate casing (e.g. 13⅜") is cemented into this hole section. Drilling continues for the next interval with a smaller bit size. Production casing (e.g. 9⅝" OD) is run to TD (total depth) and cemented in place. A final casing string (e.g. 7" OD) is cemented in place from a liner hanger from the previous casing string. Therefore, the tool-string must transverse down a cased-hole and may need to pass into a smaller diameter bore.

There is a wide range of logging tools which are designed to measure various physical properties of the rocks and fluids contained within the rocks. The logging tools include transducers and sensors to measure properties such as electrical resistance, gamma-ray density, speed of sound and so forth. The individual logging tools are combinable and are typically connected together to form a logging tool-string. Some sensors are designed to make close contact with the borehole wall during data acquisition whilst others are ideally centered in the wellbore for optimal results. These requirements need to be accommodated with any device that is attached to the tool-string. A wireline logging tool-string is typically in the order of 20 ft to 100 ft long and 2" to 5" in diameter.

In cased hole, logging tools are used to assess the strength of the cement bond between the casing and the wellbore wall and the condition of the casing. There are several types of sensors and they typically need to be centered in the casing. One such logging tool utilises high frequency ultrasonic acoustic transducers and sensors to record circumferential measurements around the casing. The ultrasonic transmitter and sensor is mounted on a rotating head connected to the bottom of the tool. This rotating head spins and enables the sensor to record azimuthal ultrasonic reflections from the casing wall, cement sheath, and wellbore wall as the tool is slowly winched out of the wellbore. Other tools have transmitters and sensors that record the decrease in amplitude, or attenuation, of an acoustic signal as it travels along the casing wall. It is important that these transducers and sensors are well centered in the casing to ensure that the data recorded is valid. Other logging tools that measure fluid and gas production in flowing wellbores may also require sensor centralisation. Logging tools are also run in producing wells to determine flow characteristics of produced fluids. Many of these sensors also require centralisation for the data to be valid.

In open hole (uncased wellbores), logging tools are used to scan the wellbore wall to determine the formation structural dip, the size and orientation of fractures, the size and distribution of pore spaces in the rock and information about depositional environment. One such tool has multiple sensors on pads that contact the circumference of the wellbore to measure micro-resistivity. Other tools generate acoustic signals which travel along the wellbore wall and are recorded by multiple receivers spaced along the tool and around the azimuth of the tool. As with the cased hole logging tools, the measurement from these sensors is optimised with good centralisation in the wellbore.

The drilling of wells and the wireline logging operation is an expensive undertaking. This is primarily due to the capital costs of the drilling equipment and the specialised nature of the wireline logging systems. It is important for these activities to be undertaken and completed as promptly as possible to minimise these costs. Delays in deploying a wireline logging tool are to be avoided wherever possible.

One cause of such delays is the difficulties in lowering wireline logging tools down to the target depth of the wellbore. The logging tool is lowered by a cable down the wellbore under the force of gravity alone. The cable, being flexible, cannot push the tool down the wellbore. Hence the operator at the top of the well has very little control of the descent of the logging tool.

The chances of a wireline logging tools failing to descend is significantly increased with deviated wells. Deviated wells do not run vertically downwards and instead extend downward and laterally at an angle from vertical. Multiple deviated wells are usually drilled from a single surface location to allow a large area to be explored and produced. As wireline logging tools are run down a wellbore with a cable under the action of gravity, the tool-string will drag along the low side or bottom of the wellbore wall as it travels downwards to the target depth. The friction or drag of the tool-string against the wellbore wall can prevent to tool descending to the desired depth. The long length of a tool string can further exacerbate problems with navigating the tool string down wellbore.

With reference to FIG. 1, in deviated wells the weight of the tool-string exerts a lateral force (PW) perpendicular to the wellbore wall. This lateral force results in a drag force which acts to prevent the tool-string descending the wellbore. The axial component of tool-string weight (AW) acts to pull the tool-string down the wellbore and this force is opposed by the drag force which acts in the opposing direction. As the well deviation increases the axial component of tool weight (AW) reduces and the lateral force (PW) increases. When the drag resulting from the lateral force (PW) equals the axial component (AW) of tool-string weight the tool will not descend in the wellbore.

As hole deviation increases, the sliding friction or drag force can prevent the logging tool descending. The practical limit is 60° from the vertical, and in these high angle wells any device that can reduce friction is very valuable. The drag force is the product of the lateral component of tool weight acting perpendicular to the wellbore wall and the coefficient of friction. It is desirable to reduce the coefficient of friction in order to reduce the drag force. The coefficient of friction may be reduced by utilising low friction materials, such as Teflon. The drag force may also be reduced by using wheels.

In deviated wells there is the potential for drilling cuttings to collect on the low side of the wellbore. Rock cuttings are more difficult to remove when the wellbore is deviated. The wellbore may also reduce in size after drilling due to swelling or movement of the subsurface rock formations. The logging tool needs to travel over or through these drilling cutting and wellbore restrictions, which can impede its progress. In some cases, the logging tool may not be able to plough through the cuttings or pass restrictions to reach the bottom of the wellbore. In cased hole, a residual sheath of cement may coat the inside of the casing to reduce the inside diameter of the casing. In other situations, the casing may be partially crushed under the action of subterranean forces. This reduced diameter of the wellbore or casing may prevent the tool-string from descending.

A common apparatus to centralise logging tools is a bow-spring centraliser. Bow-spring centralisers incorporate a number of curved leaf springs. The leaf springs are attached at their extremities to an attachment structure that is fixed to the logging tool. The midpoint of the curved leaf spring (or bow) is arranged to project radially outward from the attachment structure and tool string. When the bow-spring centraliser is not constrained by the wellbore, the outer diameter of the bow-spring centraliser is greater than the diameter of the wellbore or casing in which it is to be deployed. Once deployed in the wellbore, the bow-springs are flattened by contacting the wellbore wall and the flattened bow springs provide a centering force on the tool string. In deviated wells this centering force must be greater than the lateral weight component of the tool string acting perpendicular to the wellbore or casing wall. Consequently, more centering force acting between each bow spring and the wellbore wall is required at greater well deviations. If the centering force is too small, the centraliser will collapse and the tool sensors are not centered. If the centralising force is too great the excessive force will induce unwanted drag between the centraliser and wellbore wall which may prevent the tool descending or cause stick-slip motion of the logging tool. Stick-slip is where the tool moves up the wellbore in a series of spurts rather than at a constant velocity. Stick-slip action will compromise or possibly invalidate the acquired measurement data. The practical limit for gravity decent with using bow spring centralisers is in the order of 60 degrees from the vertical. Wellbores are vertical at shallow depths and build deviation with depth. Consequently, the centralisation force that is necessary varies within the same wellbore. As the bow spring centraliser must be configured for the highest deviations, invariably there is more drag than what is necessary over much of the surveyed interval.

With bow spring centralisers, the centralising force is greater in small wellbores, as the leaf springs have greater deflection (more compressed), than in large wellbores. Consequently, stronger or multiple bowsprings are required in larger hole sizes. These centralisers usually have "booster" kits to impart more centering force in larger wellbores or those with higher deviations.

At deviations greater than 60 degrees other methods must be used to overcome the frictional forces and enable the tool string to descend in the wellbore. One method is to use a drive device (tractor) connected to the tool string. Tractors incorporate powered wheels that forcibly contact the wellbore wall in order to drive the tool string downhole. Another method is to push the tool string down hole with drill pipe or coiled tubing. These methods involve additional risk, more equipment and involve more time and therefore cost substantially more.

In order to reduce the centraliser drag, wheels may be attached to the centre of the bow spring to contact the wellbore wall. However, the fundamental problems associated with the collapse of the leaf spring or over-powering resulting in excessive drag persist.

Another known type of centraliser consists of a set of levers or arms with a wheel at or near where the levers are pivotally connected together. There are multiple sets of lever-wheel assemblies disposed at equal azimuths around the central axis of the device. There are typically between three and six sets. The ends of each lever set are connected to blocks which are free to slide axially on a central mandrel of the centraliser device. Springs are used force these blocks to slide toward each other forcing the arms to defect at an angle to the centraliser (and tool string) axis so that the wheels carried on the pivoting arms can extend radially outward to exert force against the wellbore wall. With this type of device, the centering force depends on the type and arrangement of the energising apparatus or springs. The pivoting arm centraliser device is typically energised by means of either axial springs acting on one or both sliding blocks, or radial springs acting between the centraliser arms and a central mandrel, or a combination of both axial and radial springs, to energise or bias the arms outwards to contact the wellbore wall.

An advantage of a pivoting or hinged arm centraliser over typical bowspring centralisers is that drag is reduced by the wheels which roll, rather than slide, along the wellbore wall. However, the limitations described above in relation to bowspring centralisers still apply. Namely, the centralising force is greater in small wellbores, where the springs undergo greater deflection, than in large wellbores. At increased well deviations, more centering force is required. If the centering force is too small, the centraliser will collapse and the tool sensors are not centered. If the centralising force is too great the excessive force between the centraliser arms and the wellbore wall will induce unwanted drag which may prevent the tool descending or cause stick-slip motion of the logging tool. Consequently, it is not possible for such a hinged arm centralising device, given a known casing size, to be optimised for a range of tool-string weights and for any well deviation. In order to prevent the centraliser device from collapsing it must be designed to carry a maximum tool-string weight at the maximum deviation (horizontal). Thus, for most applications the centralising force is more than necessary which results in additional tool-string drag.

Hinged arm centralisers may be energised by active energisation means, such as hydraulic powered actuators, to force the sliding blocks together. These centralisers are far more complex than passive or spring energised centralisers, and like powered tractor devices, involve additional risk, more equipment and more time and therefore cost substantially more to operate and maintain. These devices are powered from surface via the logging cable and consequently must be connected axially to the tool string between individual tools to receive power. The logging tools may be flexible and the tool sensors requiring centralisation may be at a distance from the ends of the logging tool. Thus, this type of centraliser may not be effective. A centering device that fits over the tool housing is more effective in this instance.

One other device used to centralise a sensor assembly in a well bore is a fixed standoff comprising multiple radial projections disposed at equal azimuths around the central axis of the device. The radial projections present an outer diameter that is smaller than the smallest diameter of the wellbore and hold the tool string off the bottom side of the wellbore. However, due to anticipated wellbore restrictions, the outer diameter of the fixed standoff must be significantly smaller than the nominal wellbore diameter to avoid the risk of the tool string getting stuck downhole. Therefore, accurate centering of the sensors is not achieved.

The reference to any prior art in the specification is not, and should not be taken as, an acknowledgement or any form of suggestion that the prior art forms part of the common general knowledge in any country.

DISCLOSURE OF INVENTION

It would be an advantage to have a centralising device that centered the tool string in a wellbore to an acceptable tolerance, without exerting more centering force than was absolutely necessary, for a range of tool string weights and well deviations.

It is an object of the present invention to address any one or more of the above problems or to at least provide the industry with a useful device for transporting sensor equipment in a bore or pipe.

According to a first aspect of the present invention there is provided a device for transporting a sensor assembly down a bore, the device comprising:

a plurality of wheels azimuthally spaced apart around a longitudinal axis of the device, each wheel presenting a radial extremity of the device, the wheels moveably supported to move between a minimum outer diameter of the device and a maximum outer diameter of the device;

an adjustable stop mechanism configured to pre-set the maximum outer diameter of the device within a range of maximum outer diameters so that the device is configurable for use in a pre-determined range of bore diameters; and one or more spring elements to bias the wheels radially outwards, and wherein the one or more spring elements are preloaded to provide a radial force to the wheels when at the pre-set maximum outer diameter.

In some embodiments, the one or more spring elements is configured to bias the wheels radially outwards to a radially outermost unloaded position at an unloaded outer diameter of the device; and wherein the pre-set maximum outer diameter is smaller than the unloaded outer diameter so that the one or more spring elements are preloaded to provide the radial force to the wheels when at the pre-set maximum outer diameter.

In some embodiments, the outer diameter range corresponds to a range of bore diameters so that the pre-set maximum outer diameter is settable to be equal to or slightly less than a bore diameter.

In some embodiments, the adjustable stop mechanism is configured to pre-set the maximum outer diameter of the device so that the device supports the sensor assembly as it traverses along a bore without contacting opposite sides of the bore.

In some embodiments, the adjustable stop mechanism is configured to pre-set the maximum outer diameter of the device so that the wheels contact the bore wall on only one side of the bore.

In some embodiments, the outer diameter range corresponds to a range of nominal wellbore diameters relating to a range of wellbore casing weights for a nominal wellbore casing diameter.

In some embodiments, the nominal wellbore casing diameter is a 7" outside diameter, the range of wellbore casing weights giving a range of wellbore nominal inner diameters of 5.25" to 6.45".

In some embodiments, the adjustable stop mechanism is configured so that the pre-set maximum outer diameter is infinitely settable in the outer diameter range.

In some embodiments, the one or more spring elements are preloaded to provide the radial force to the wheels when at the pre-set maximum outer diameter so that the device supports the sensor assembly at the pre-set maximum diameter as it traverses along a bore. The preload of the springs ensures the wheels remain at the pre-set maximum outer diameter without collapsing under the weight of the sensor assembly. Yet when the device encounters a bore restriction, the wheels can collapse inwards against the spring force to allow the device and sensor assembly to pass through the restriction.

In some embodiments, the one or more spring elements are preloaded to support the weight of the sensor assembly together with other said devices, so that the wheels remain at the pre-set maximum outer diameter as the device transports the sensor assembly along a nominal diameter section of a deviated wellbore.

In some embodiments, the device is configured to carry the sensor assembly at or near to a centreline of the bore when the wheels are at the pre-set maximum outer diameter.

In some embodiments, with the wheels at the unloaded diameter, the one or more spring elements is an unloaded (elastically undeformed) state.

In some embodiments, the wheels are movably supported to be coupled to move together simultaneously so that the wheels lie on a substantially circular curve at the minimum outer diameter and at the pre-set maximum outer and at any diameter in between.

In some embodiments, the wheels are movably supported to be coupled to move together so that, in use, when one wheel is pushed radially inwards when encountering a wellbore restriction, all of the wheels are moved radially inwards together to or towards the minimum outer diameter.

In some embodiments, each wheel is moveably supported to move between the minimum outer diameter and the pre-set maximum outer diameter independently of the other wheels.

In some embodiments, the device comprises a frame adapted to attach the device to the sensor assembly, and a plurality of arm assemblies azimuthally spaced apart around the frame, each arm assembly comprising a said wheel and configured to move the wheel between the minimum outer diameter and the maximum outer diameter, the one or more spring elements biasing the arm assemblies radially outwards.

In some embodiments, each arm assembly comprises:

a support member adapted to move axially along the frame;

a first arm pivotally attached to the frame via a first pivot joint;

a second arm pivotally attached to the support member via a second pivot joint;

the first and second arms pivotally attached together by a third pivot joint, the wheel mounted at or adjacent to the third pivot joint;

wherein axial movement of the support member away from and towards the wheels moves the wheels between the minimum outer diameter and the pre-set maximum outer diameter of the device by pivoting of the first and second arms about the first and second pivot joints.

In some embodiments, the one or more spring elements are arranged axially to bias the support member axially towards the wheels.

In some embodiments, the one or more spring elements comprises a plurality of spring elements azimuthally spaced around the longitudinal axis of the frame.

In some embodiments, the one or more spring elements are collinear with the frame.

In some embodiments, the one or more spring elements comprises a stack of Belleville washers, or one or more coil springs.

In some embodiments, the device comprises a frame adapted to attach the device to the sensor assembly and a support member adapted to move axially along the frame; and wherein the one or more spring elements comprises a plurality of cantilever spring elements; and wherein each arm assembly comprises:

a first arm configured as a said cantilever spring element, with an inner end of the first arm fixed to the frame;

a second arm, an inner end of the second arm pivotally attached to a support member via a first pivot joint; and the first and second arms pivotally attached together by a second pivot joint at or adjacent outer ends of the first and second arms; and the wheel mounted at or adjacent to the second pivot joint;

wherein axial movement of the support member away from and towards the wheels moves the wheels between the minimum outer diameter and the pre-set maximum outer diameter of the device by pivoting of the second arms about the first pivot joints and elastic bending of the first arms, the elastic bending of the first arms biasing the wheels radially outwards.

In some embodiments, the second pivot joint has a pivot axis collinear with a rotational axis of the wheel.

In some embodiments, the device comprise a frame adapted to attach the device to the sensor assembly and a support member adapted to move axially along the frame; and wherein the one or more spring elements comprises a plurality of bow springs azimuthally spaced apart around the longitudinal axis of the device, each bow spring supporting a said wheel to move between the minimum outer diameter and the maximum outer diameter by elastic deflection of the bow spring;

a first end of the bow spring coupled to the frame, and a second end of the bow spring coupled to the support member;

wherein axial movement of the support member away from and towards the wheels moves the wheels between the minimum outer diameter and the pre-set maximum outer diameter of the device by elastic bending of the bow springs, the elastic bending of the bow springs biasing the wheels radially outwards.

In some embodiments, the adjustable stop mechanism comprises a stop component configured to be adjustable to a set position relative to the frame, in the set position the stop component setting the maximum outer diameter.

In some embodiments, the device comprises a support member adapted to move axially along the frame, wherein the arm assemblies are coupled to the support member so that axial movement of the support member away from and towards the wheels moves the wheels between the minimum outer diameter and the pre-set maximum outer diameter; and, in the set position the stop component engages one or more said arm assemblies or the support member to prevent the arm assemblies moving radially outwards.

In some embodiments, the adjustable stop mechanism comprises a threaded engagement between the stop component and the frame, wherein relative rotation between the stop component and the frame adjusts a position of the stop component axially along the frame.

In some embodiments, the adjustable stop mechanism comprises a locking mechanism to lock the stop component in the set position.

In some embodiments, the locking mechanism is a lock nut.

In some embodiments, each arm assembly comprises an arm, an inner end of the arm pivotally attached to the frame, and the wheel mounted to the arm adjacent to an outer end of the arm;

wherein the arm moves the wheel between the minimum outer diameter and the pre-set maximum outer diameter of the device by pivoting of the arm about the pivot joint; and wherein an outer end of the arm is uncoupled from the other said arms.

In some embodiments, the one or more spring elements comprises a plurality of spring elements azimuthally spaced around the longitudinal axis of the frame, each spring element acting between the frame and a said arm.

In some embodiments, the one or more spring elements comprises a plurality of cantilever spring elements; and wherein each arm assembly comprises an arm configured as a said cantilever spring element, with an inner end of the arm fixed to the frame, and the wheel mounted to the arm adjacent to an outer end of the arm;

wherein the arm moves the wheel between the minimum outer diameter and the pre-set maximum outer diameter of the device by elastic bending of the arm, the elastic bending of the arm biasing the wheel radially outwards; and wherein an outer end of the arm is uncoupled from the other said arms.

In some embodiments, each cantilever spring element extends in a plane coincident with the longitudinal axis of the device.

In some embodiments, each cantilever spring comprises a portion that extends circumferentially around the longitudinal axis of the device.

In some embodiments, the adjustable stop mechanism comprises a stop component configured to be adjustable to a set position relative to the frame, in the set position, engagement between the stop component and the arms preventing radial outward movement of the arms.

In some embodiments, the stop component presents a radial inwardly facing surface to engage a radial outwardly facing surface of each arm.

In some embodiments, one of the radially inwardly facing surface and the radially outwardly facing surface is inclined to the longitudinal axis of the device, so that axial movement of the stop component presents the outer diameter range in which the pre-set maximum outer diameter is settable.

In some embodiments, the adjustable stop mechanism comprises a threaded engagement between the stop component and the frame, wherein relative rotation between the stop component and the frame adjusts a position of the stop component axially along the frame.

In some embodiments, the adjustable stop mechanism comprises a locking mechanism to lock the stop component in the set position.

In some embodiments, the device is a passive device, with biasing of the wheels radially outwards being provided by the one or more spring elements of the device only.

In some embodiments, the sensor assembly is a wireline logging tool string, and the device is adapted for transporting the wireline logging tool string in a wellbore during a wireline logging operation.

According to a second aspect of the present invention there is provided a tool string and a plurality of transportation devices for transporting the tool string down a well bore, each transportation device as described above. In some embodiments, the one or more spring elements of each device is configured so that the devices collectively support the weight of the tool string in a deviated wellbore so that the wheels of the devices remain at the pre-set maximum outer diameter as the devices transport the tool string along a nominal inner diameter section of a deviated wellbore.

According to a third aspect of the present invention there is provided a device for centering a sensor assembly in a bore, the device comprising:

a plurality of radially extending collapsible standoffs azimuthally spaced apart around a longitudinal axis of the device, each collapsible standoff comprising a wheel moveably supported to move between a minimum outer diameter of the device and a maximum outer diameter of the device that is smaller than the diameter of the bore in use; and one or more spring elements to bias the wheels radially outwards so that the device supports the sensor assembly substantially centrally within the bore when traversing a nominal diameter section of the bore with the wheels at the maximum outer diameter of the device, while allowing the wheels to move radially inwards to or towards the minimum outer diameter to allow the device to traverse through bore restrictions.

The device according to the third aspect may comprise any one or more of the features described above in relation to the first aspect of the invention.

According to a fourth aspect of the present invention there is provided a method for transporting a sensor assembly along a bore, the method comprising:

providing a plurality of transportation devices, each device comprising:

a plurality of wheels azimuthally spaced apart around a longitudinal axis of the device, each wheel presenting a radial extremity of the device, the wheels moveably supported to move between a minimum outer diameter of the device and a maximum outer diameter of the device, and one or more spring elements to bias the wheels radially outwards;

configuring each device so that the maximum outer diameter of the device is less than or equal to the diameter of the bore, and so that the one or more spring elements are preloaded to provide a radial force to the wheels when at the maximum outer diameter sufficient to support the sensor assembly as it traverses along the bore;

attaching the plurality of transportation devices to the sensor assembly, including spacing the devices axially apart along a length of the sensor assembly; and lowering the sensor assembly and the plurality of transportation devices down the bore on a wireline to descend down the bore under gravity.

In some embodiments, the wheels of the devices carry the sensor assembly along the bore while contacting on one side of the bore only, or without contacting an opposite side of the bore.

In some embodiments, each device is a device according to the first aspect of the invention, and the method comprises adjusting the adjustable stop mechanism of each device so that the pre-set maximum outer diameter of each device is equal to or slightly smaller than the diameter of the bore.

In some embodiments, the method is for transporting the sensor assembly along a pipe or cased bore and the method comprises adjusting the adjustable stop mechanism of each device so that the pre-set maximum outer diameter of each device is approximately 0.1 inch smaller than the diameter of the bore.

In some embodiments, the method comprises placing a section of pipe the same size or smaller than the bore over each device and adjusting the mechanical stop mechanism until the pre-set maximum outer diameter is equal to or slightly less than the ID of the pipe.

Unless the context suggests otherwise, the term "wellbore" may to refer to both cased and uncased wellbores. Thus, the term 'wellbore wall' may refer to the wall of a wellbore or the wall of a casing within a wellbore.

Unless the context suggests otherwise, the term "tool string" refers to an elongate sensor package or assembly also known in the industry as a "logging tool", and may include components other than sensors such as guide and orientation devices and transportation devices attached to sensor components or assemblies of the tool string. A tool string may include a single elongate sensor assembly, or two or more sensor assemblies connected together.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIG. 2A is an isometric view of the device with wheels at a pre-set maximum outer diameter. FIG. 2B is an isometric view of the device with the wheels at an unloaded outer diameter with spring elements of the device in an unloaded state. FIG. 2C is a cross section of the device on line A-A in FIG. 2D. FIG. 2D is an end view of the device with the wheels at the unloaded outer diameter with a well bore diameter indicated by a dashed line. FIG. 2E is a cross section of the device on line B-B in FIG. 2F with the wheels at the pre-set maximum outer diameter. FIG. 2F is an end view of the device in a wellbore with the wheels at the pre-set maximum outer diameter. FIG. 2G is a cross section of the device on line C-C in FIG. 2H with the wheels at a minimum outer diameter. FIG. 2H is an end view of the device in a wellbore with the wheels at the minimum outer diameter.

FIG. 3A is an isometric view of the device with wheels at a pre-set maximum outer diameter. FIG. 3B is a cross section of the device on a longitudinal centerline of the device with the wheels at the unloaded outer diameter. FIG. 3C is a cross section of the device on a centreline of the device with the wheels at a pre-set maximum outer diameter. FIG. 3D is a cross section of the device on a longitudinal centreline of the device with the wheels at a minimum outer diameter.

FIG. 4A is an isometric view of the device with wheels at a pre-set maximum outer diameter, with a portion of a support member cut away to show a spring element. FIG. 4B is a cross section of the device on a longitudinal centerline of the device with the wheels at the unloaded outer diameter. FIG. 4C is a cross section of the device on a centreline of the device with the wheels at a pre-set maximum outer diameter. FIG. 4D is a cross section of the device on a longitudinal centreline of the device with the wheels at a minimum outer diameter.

FIG. 5A is an isometric view of the device with wheels at a pre-set maximum outer diameter. FIG. 5B is an isometric view of the device with the wheels at an unloaded outer diameter with spring elements of the device in an unloaded state. FIG. 5C is a cross section of the device on line D-D in FIG. 5E but with the wheels at the unloaded outer diameter. FIG. 5D is a cross section of the device on line D-D in FIG. 5E with the wheels at the pre-set maximum outer diameter. FIG. 5E is an end view of the device in a wellbore with the wheels at the pre-set maximum outer diameter. FIG. 5F is a cross section of the device on line E-E in FIG. 5G with the wheels at a minimum outer diameter. FIG. 5G is an end view of the device in a wellbore with the wheels at the minimum outer diameter.

FIG. 6A is an isometric view of the device with wheels at a pre-set maximum outer diameter. FIG. 6B is an isometric view of the device with the wheels at an unloaded outer diameter with spring elements of the device in an unloaded state. FIG. 6C is a cross section of the device on line F-F in FIG. 6E but with the wheels at the unloaded outer diameter. FIG. 6D is a cross section of the device on line F-F in FIG. 6E with the wheels at the pre-set maximum outer diameter. FIG. 6E is an end view of the device in a wellbore with the wheels at the pre-set maximum outer diameter. FIG. 6F is a cross section of the device on line G-G in FIG. 6G with the wheels at a minimum outer diameter. FIG. 6G is an end view of the device in a wellbore with the wheels at the minimum outer diameter.

FIG. 7A is an isometric view of the device with wheels at a pre-set maximum outer diameter. FIG. 7B is an isometric view of the device with the wheels at an unloaded outer diameter with spring elements of the device in an unloaded state. FIG. 7C is a cross section of the device on line H-H in FIG. 7E but with the wheels at the unloaded outer diameter. FIG. 7D is a cross section of the device on line H-H in FIG. 7E with the wheels at the pre-set maximum outer diameter. FIG. 7E is an end view of the device in a wellbore with the wheels at the pre-set maximum outer diameter. FIG. 7F is a cross section of the device on line I-I in FIG. 7G with the wheels at a minimum outer diameter. FIG. 7G is an end view of the device in a wellbore with the wheels at the minimum outer diameter.

FIG. 8A is an isometric view of the device with wheels at a pre-set maximum outer diameter. FIG. 8B is an isometric view of the device with the wheels at an unloaded outer diameter with spring elements of the device in an unloaded state. FIG. 8C is a cross section of the device on a centreline of the device with the wheels at the unloaded outer diameter. FIG. 8D is a cross section of the device on a centreline of the device with the wheels at the pre-set maximum outer diameter. FIG. 8E is a cross section of the device on a centreline of the device with the wheels at a minimum outer diameter.

FIG. 9A is an isometric view of the device with wheels at a pre-set maximum outer diameter. FIG. 9B is an isometric view of the device with the wheels at an unloaded outer diameter with spring elements of the device in an unloaded state. FIG. 9C is a cross section of the device on a centreline of the device with the wheels at the unloaded outer diameter. FIG. 9D is a cross section of the device on a centreline of the device with the wheels at the pre-set maximum outer diameter. FIG. 9E is a cross section of the device on a centreline of the device with the wheels at a minimum outer diameter.

BEST MODES FOR CARRYING OUT THE INVENTION

Figure 1:
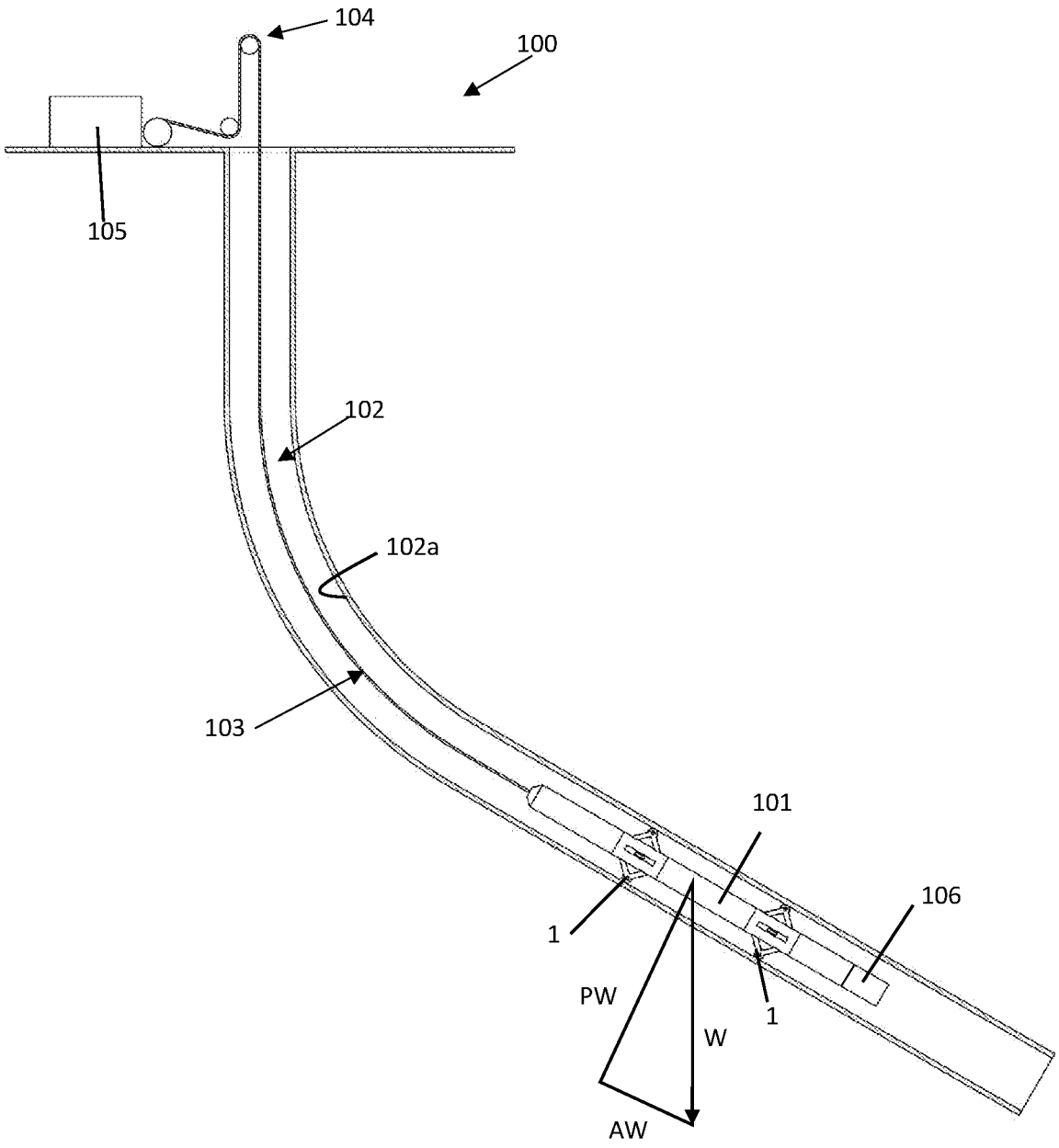
FIG. 1 is a schematic representation of a well site and a tool string descending a wellbore in a wireline logging operation.

FIG. 1 provides a schematic representation of a well site 100. A logging tool string 101 is lowered down the wellbore 102 on a wireline 103. Wellsite surface equipment includes sheave wheels 104 typically suspended from a derrick and a winch unit 105 for uncoiling and coiling the wireline to and from the wellbore, to deploy and retrieve the logging tool 101 to and from the wellbore to perform a wellbore wireline logging operation. The logging tool string 101 may include one or more elongate sensor assemblies or logging tools each carrying one or more sensors 106 coupled together to form the logging tool string 101. The wireline 102 includes a number of wires or cables to provide electrical power to the one or more sensors 106 and transmit sensor data to the wellsite surface. One or more transportation devices 1 are provided to the logging tool 101 to transport the logging tool 101 in the wellbore 102. The logging tool 101 is carried by the transportation devices 1 as it descends under gravity down the wellbore, and as it ascends up the wellbore as it is retrieved by the wireline 103 during a logging operation.

FIGS. 2A to 2H illustrate a transportation device 200 to be provided with or as part of the tool string 101. The transportation device 200 comprises a mandrel or frame 2 with a bore to slip over an outside of the tool string, with the tool string received in the bore of the mandrel or frame 2. Screws (not shown) are provided through (threaded) holes 3 in the frame 2 to engage corresponding holes in the tool string to couple the frame to the tool string. Other coupling arrangements to couple the transportation device 200 to the tool string 101 are possible. For example, the device 200 may include a locking collar at each end to couple the device in line with the tool string 101. Alternatively, the device 200 may be integral with the tool string, e.g. an outer housing of the tool string 101 may form a central mandrel or frame of the device 200. Alternatively, the device may be connected axially between the individual tools of the tool string.

A plurality of rollers or wheels 6 (herein wheels) are azimuthally spaced apart around the longitudinal axis 5 of the device (the wheels are spaced circumferentially apart around the longitudinal axis of the device 200). In the illustrated embodiment there are five wheels, however the device may have three, four, five, six or more wheels.

An outside diameter of the wheel defines a radially outermost extent or radial extremity (refer 6*a* in FIG. 2F) of the device 200. Each wheel 6 is mounted to rotate on a rotational axis to present a low friction interface when in contact with the wellbore wall 102*a*. The rotational axis of each wheel 6 is perpendicular to the longitudinal axis 5 of the device 200 so that the device 200 is carried on two or more wheels 6 when in contact with the wellbore wall, as described in more detail below.

The radial extremities 6*a* of the device provided by the wheels together present an outer diameter of the transportation device. That is, the radial extremities lie on a substantially circular curve, wherein the diameter of the circular curve presents the outer diameter of the device.

Figure 2A:
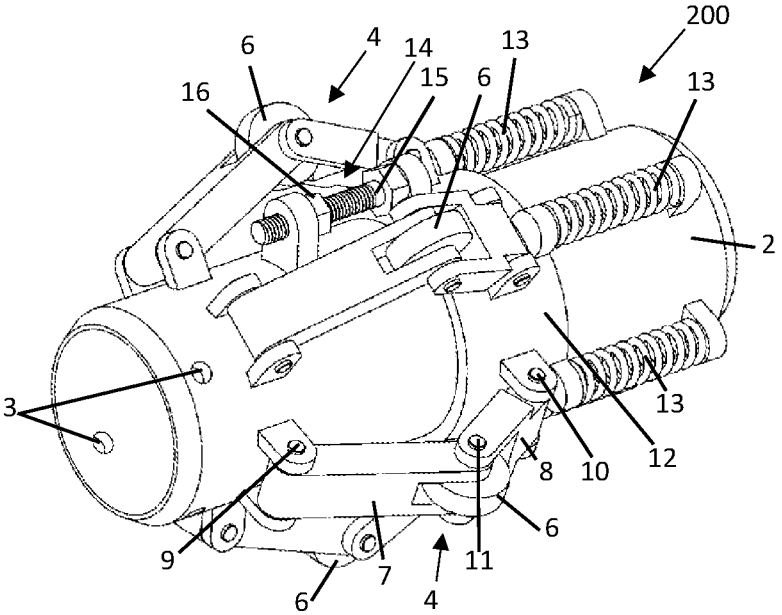
FIGS. 2A to 2H show a transportation device according to one embodiment of the present invention.
Figure 2B:
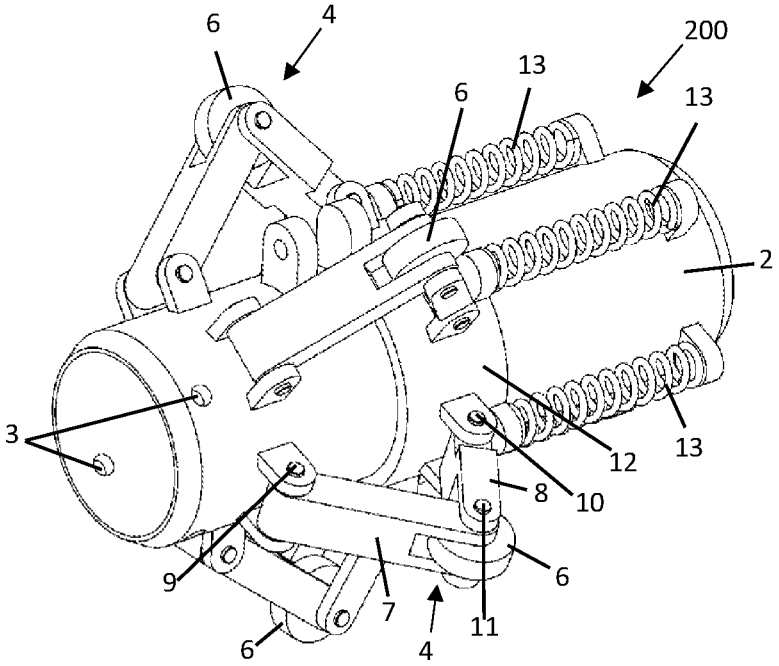
Figure 2D:
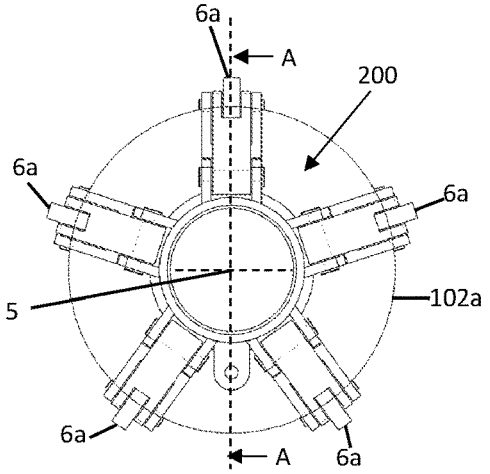
Figure 2C:
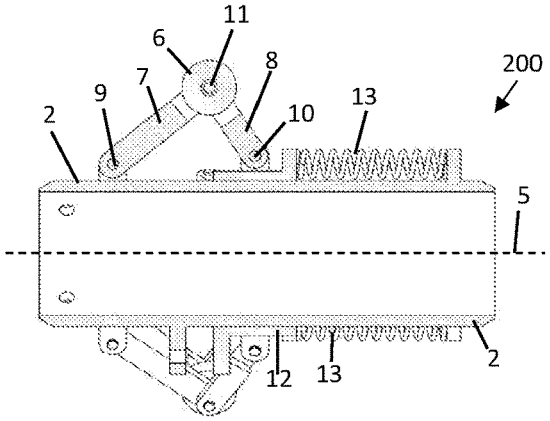
Figure 2F:
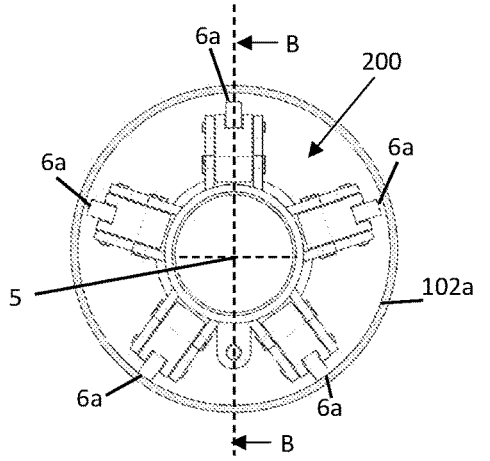
Figure 2E:
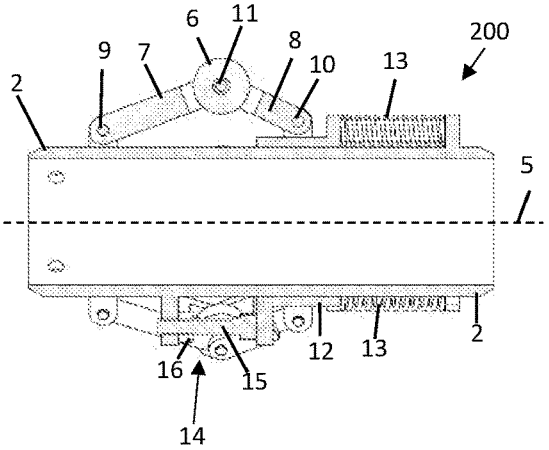
Figure 2H:
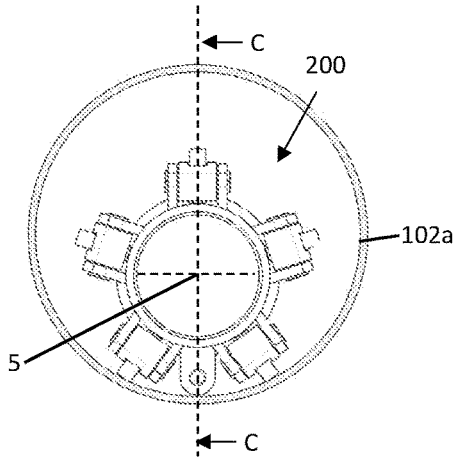
Figure 2G:
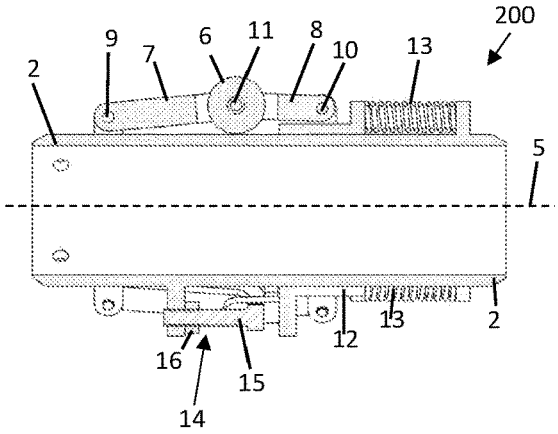
Figure 3A:
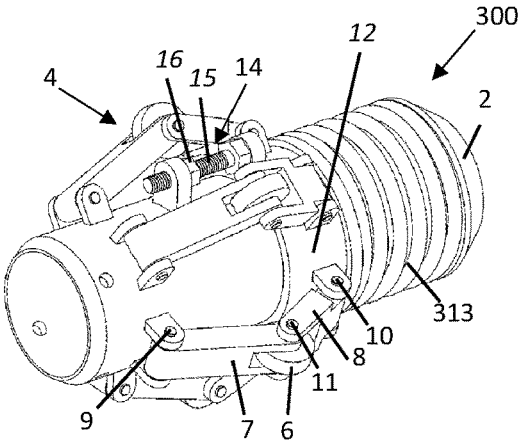
FIGS. 3A to 3D show a transportation device according to one embodiment of the present invention.
Figure 3B:
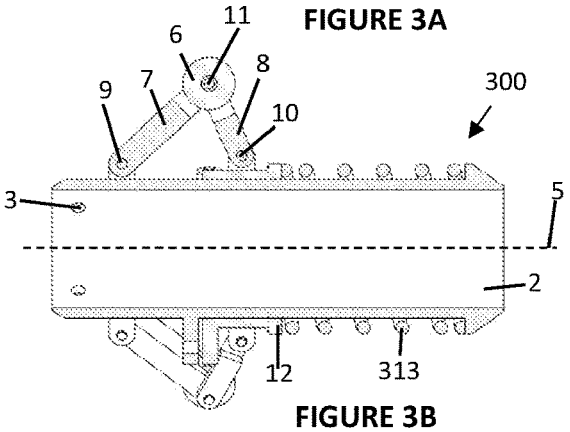
Figure 3C:
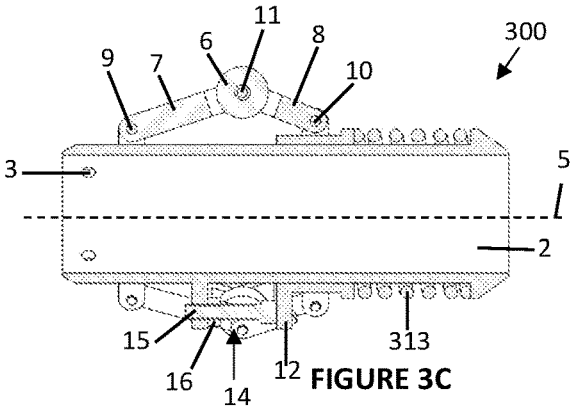
Figure 3D:
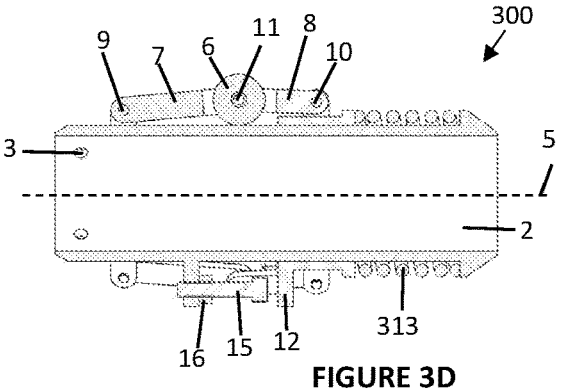

The wheels 6 are movably supported so that the outer diameter of the device is variable. In the illustrated embodiment, the device has a plurality of arm assemblies azimuthally spaced apart around the longitudinal axis 5 of the device. Each arm assembly 4 comprises a said wheel 6. The arm assemblies provide movable supports, to movably support the wheels to move between a radial inward position and a radial outward position with respect to the longitudinal axis 5, and therefore to move between a minimum outer diameter and a maximum outer diameter of the device. FIGS. 2E and 2F show the arm assemblies 4 in a radially outward position with the wheels positioned at the maximum outer diameter of the device, and FIGS. 2G and 2H show the arm assemblies in a radially innermost position with the wheels positioned at the minimum outer diameter of the device.

One or more spring elements 13 bias the arm assemblies 4 and therefore wheels 6 radially outwards. FIGS. 2B and 2C show the arm assemblies in a radially outward position with the spring(s) in an unloaded (elastically undeformed) state. With the springs in the unloaded state, the wheels may be said to be in a radially outermost unbiased or unloaded position. In the radially outermost unloaded position, the wheels 6 present an unbiased or unloaded outer diameter of the device 200. In the unloaded position the diameter of the substantially circular curve formed by the radial wheel extremities 6*a* is larger than the diameter of the wellbore.

In the illustrated embodiment, each arm assembly 4 comprises a first arm or link 7 and a second arm or link 8. The first arm 7 is pivotally attached to the mandrel or frame 2 (herein frame) via a first pivot joint 9 at or adjacent an inner end of the first arm, to pivot relative to the frame 2. The second arm 8 is pivotally attached to a support member 12 received on the frame 2 via a second pivot joint 10 at or adjacent an inner end of the second arm, to pivot relative to the frame 2. The first and second arms 7, 8 are pivotally attached together by a third pivot joint 11 at or adjacent an outer end of each arm. The wheel 6 is mounted at or adjacent to the third pivot joint 11. The third pivot joint 11 may have a pivot axis collinear with the rotational axis of the wheel 6.

The support member 12 is configured to move axially along the frame 2. The support member 12 couples the arm assemblies 4 together so that axial movement of the support member 12 towards and away from the wheels 6 radially extends and retracts the wheels 6 between the minimum diameter and the maximum diameter of the device 200 by pivoting of the first and second arms 7, 8 about the first and second pivot joints 9, 10. The circular curve formed by the wheel extremities 6*a* at the minimum and maximum diameters and any diameter in between has a centre coincident with the longitudinal axis 5 of the device 200.

The support member 12 may comprise a collar or annular member collinear with and received on the frame 2 to slide thereon. The support member may comprise a number of parts assembled together about the frame 2. The support member 12 may be keyed to the frame to rotationally fix the support member to the frame so that the support member moves axially on the frame without relative rotation between the support member and the frame.

The transportation device 200 comprises a mechanical stop mechanism 14 to limit the radial outward movement of the wheels to set a maximum radial position to present a pre-set or operating maximum outer diameter for the device 200. The pre-set maximum outer diameter is less than the unloaded outer diameter of the device as shown by FIGS. 2D and 2F, so that the wheels 6 are biased outwards when the wheels 6 are at the pre-set maximum outer diameter. When the wheels 6 are at the pre-set maximum outer diameter, the one or more spring elements 13 are preloaded (energised) to provide a radial force to the wheels 6 via the arms 7, 8. With the wheels at the pre-set maximum diameter, the radial force provided by the springs is sufficient to support the weight of the device and the tool string, so that the wheels remain at the pre-set maximum outer diameter of the device as the device transports the tool string along the well bore even when in deviated sections of the wellbore, with the weight of the tool string carried on wheels of the device.

FIGS. 2E and 2F show the device 200 with the wheels 6 in the pre-set maximum outer diameter position. In use, the pre-set maximum outer diameter is preferably set to be slightly less than an inner diameter of the wellbore, as shown in FIG. 2F. With the pre-set maximum outer diameter slightly less than the ID of the wellbore, the wheels 6 of only two arm assemblies 4 are in contact with the wellbore wall. In a highly deviated wellbore, the transportation device traverses a lower side of the wellbore on two wheels of the device only. Since only two wheels are in contact with the wellbore wall, friction between the device and the wellbore wall is reduced. Additionally, friction between the wheels and the wellbore wall is due to the weight of the tool string and the transportation device only. The wheels are not forced against opposite sides of the wellbore wall by springs biasing the wheels radially outwards since the device is in contact with one side of the wellbore only. This configuration of the device with a pre-set maximum outer diameter less than the wellbore diameter and with a spring preload configured to overcome the weight of the tool-string and device, therefore provides a low friction contact or interface between the wellbore and the transportation device.

Additionally, with the pre-set maximum outer diameter slightly less than the wellbore diameter, the transportation device 200 maintains the tool string and tool string sensors near to the centreline of the wellbore. The centering of the tool string and the low friction interface combine to achieve the collection of high-quality wellbore data. The pre-set maximum outer diameter may be around 0.1 inch smaller than the wellbore casing diameter, so that the sensors are carried 0.05 inch from the wellbore centreline. One skilled in the art will appreciate that the pre-set maximum outer diameter may be set to be equal to the wellbore inner diameter, in which case, theoretically speaking, all of the wheels may be in contact with the wellbore wall yet with the spring elements 13 presenting a practically zero force to the upper side of the wellbore wall. However, in practice, due to mechanical tolerances, it is expected that the pre-set maximum outer diameter should be slightly less than the wellbore diameter. In an open hole (uncased wellbore) the pre-set maximum outer diameter may be smaller than the nominal wellbore diameter by around 0.5 inch to 1 inch or more. In a large uncased bore, for example a nominal uncased bore diameter of 12¼ inches, centering sensors is less critical.

The pre-set maximum outer diameter may be set by placing a section of pipe the same size as the wellbore casing over the device and adjusting the mechanical stop mechanism 14 until the pre-set maximum outer diameter is slightly less than the ID of the pipe. A gauge may be placed between one or more wheels and the pipe to set the pre-set maximum outer diameter, or pipe gauges may be used to pre-set the maximum diameter before logging operations. For example a gauge may comprise a cylindrical member such a length of pipe, with a stepped bore comprising a plurality of inner diameters, each corresponding to a diameter that is equal to or slightly less than a corresponding bore diameter. In some embodiments, the device may include an adjustment scale, for example a scale on the frame, to indicate the pre-set outer diameter for a given position of the stop component.

Furthermore, since the arm assemblies with wheels are movable between the pre-set maximum outer diameter as shown in FIGS. 2E and 2F and the minimum outer diameter of the device with the wheels 6 at the inner most radial position as shown in FIGS. 2G and 2H, the wheels can be deflected radially inwards from the pre-set maximum outer diameter of the device when encountering a wellbore restriction. The wheels and moveable supports 4 therefore provide a plurality of collapsible standoffs to a tool string, that centralise the tool string when at the pre-set maximum outer diameter of the device, yet collapse from the pre-set maximum outer diameter to or towards the minimum outer diameter of the device when one or more of the wheels 6 encounters a wellbore restriction. When one or more wheels 6 encounters (hits) a wellbore restriction, an axial force is applied to the wheel(s) and transferred through the arm assemblies 4 due to the weight of the heavy tool string traversing along the wellbore. An axial force applied to the wheels 6 results in an inward radial force component applied to the wheel(s) in addition to the radial force applied by the weight of the tool string 101. The additional inward radial force causes the wheels to collapse inwards so that the device and tool string can pass through the restriction under gravity as it traverses down the wellbore. A tool-string is typically very long (20 ft to 100 ft) requiring multiple transportation devices spaced apart along the tool string. The multiple devices collectively support the weight of the tool string in a deviated wellbore. Each device 200 may have a pre-load to support a portion of the weight of the tool string 101 only, such that in combination the devices 200 collectively carry the entire weight of the tool string 101. However, each transportation device individually encounters a single wellbore restriction. Therefore, while the spring elements of each device 200 is preloaded to support a corresponding section of a tool string 101, when a single device 200 encounters a wellbore restriction, the entire weight of the tool-string acts axially on the wheels of that transportation device due to the motion of the tool string along the wellbore, causing the wheels of that device to collapse radially inwards to allow the device to pass through the restriction under gravity. Similarly, during ascent, tension on the wireline pulls the device 200 against a wellbore restriction to apply an axial load to the wheels to again collapse the wheels radially inwards and allow the device 200 to pass through the restriction.

Thus, the device 200 achieves a lower friction interface of the tool-string 101 as described above, and additionally provides for centering of the tool string while also allows for the device 200 to traverse through wellbore restrictions. Once the device 200 has traversed through a wellbore restriction, the spring elements 13 return the wheels 6 to the pre-set maximum outer diameter to continue to centre the device 200 and tool-string 101 in the wellbore.

The mechanical stop mechanism 14 is adjustable to provide an adjustable pre-set maximum outer diameter. This allows the device 200 to be configured for use in a range of wellbore diameters, to closely position the tool string 101 in the centre of the well bore for a range of wellbore diameters. For example, a common wellbore casing diameter is 7 inch outside diameter, however, depending on the well parameters, different weight casings can be specified with each different weight casing having a different casing wall thicknesses and therefore casing ID. The internal diameter for 7 inch casings can range from 5.25 inches to 6.45 inches (corresponding to 57 and 20 lbs/ft specification) depending on the casing wall thickness. The adjustable mechanical stop mechanism 14 can be set so that the pre-set maximum outer diameter of the device 200 is slightly less than the specific wellbore internal diameter for each logging operation.

The adjustable mechanical stop mechanism 14 comprises a stop component 15 moveably coupled to the frame 2 to be adjusted to a set position axially along the frame 2. In a set position as shown in FIG. 2E, the stop component 15 engages the support member 12 to prevent axial movement of the support member 12 towards the wheels 6, to set the pre-set maximum outer diameter of the device 200. The stop component 15 continues to allow axial movement of the support member 12 axially away from the wheels 6, to allow the wheels 6 to collapse radially inwards when encountering a wellbore restriction.

In the illustrated embodiment, a threaded engagement is provided between the stop component 15 and the frame 2. The threaded engagement allows the stop component 15 to move axially along the frame 2 by relative rotation between the component 15 and the frame 2. The stop component 15 has an external thread and the frame 2 has a corresponding internal thread. The stop component is a threaded fastener (bolt). An end of the threaded faster 15 presents an abutment surface, to engage a corresponding abutment surface on the support member 12. The support member abutment surface is provided by a radial flange on the support member. The load on the spring elements 13 must be increased in order to separate the corresponding abutment surfaces and move the arm assemblies 4 radially inwards from the pre-set maximum outer diameter. A locking mechanism 16 may be provided to lock the stop component 15 in the set position to prevent the stop component 15 moving during use. For example, a lock nut 16 is provided to prevent the stop component 15 from unthreading.

A threaded engagement is preferred as a means to adjust the position of the stop component 15. A threaded engagement presents an infinitely settable stop position so that the pre-set maximum outer diameter is infinitely settable in the outer diameter range. This allows the pre-set maximum outer diameter to be set very close to (slightly less than) the inner diameter of the wellbore, for example 0.1 inch as described above. In a less preferred arranging an indexed adjustable stop mechanism may be provided, for example by a pin placed in aligned holes in the support member 12 and frame 2, with a plurality of holes provided in the support member or frame or both. Other adjustable stop mechanisms are possible. For example, a fixed stop may be provided on the mandrel 2, with packers or shims provided between the fixed stop and the sliding support member 12. Alternative mechanisms to set the maximum outer diameter are illustrated by the embodiments of FIGS. 4A-4D, 5A-5G and 7A-7G.

In the embodiment of FIGS. 2A to 2H, the one or more spring elements 13 are azimuthally spaced around the frame or longitudinal axis 5 of the device. The spring elements 13 are arranged axially to bias the support member 12 axially towards the wheels 6, to bias the arm assemblies 4 with wheels 6 radially outwards. In this example embodiment, each spring element is a coil spring 13. The spring elements 13 are loaded in compression between the frame 2 and the support member 12. The spring elements are compressed in order to separate the support member 12 and stop component 15 abutment surfaces and move the arm assemblies radially inwards from the pre-set maximum outer diameter. One skilled in the art will appreciate other spring arrangements are possible, as will be apparent from other embodiments described below. The spring elements may be arranged in tension, so that the spring elements must be further tensioned to separate the stop component and support member to move the wheels radially inwards.

FIGS. 3A to 3D illustrate another embodiment of a transportation device 300 according to the present invention. The device 300 is similar to the device 200 illustrated in FIGS. 2A to 2H. The same reference numerals are used to reference the same or similar components for both embodiments. In the device 300 of FIGS. 3A to 3D, the spring element 313 is a coil spring collinear with the frame 2. The embodiment of FIGS. 3A to 3D has the same configuration as the embodiment of FIGS. 2A to 2H but for the arrangement of the spring elements and associated spring element mounting details provided on the support member 12 and the frame 2.

FIGS. 4A to 4D illustrate another embodiment of a transportation device 400 according to the present invention. The reference numerals used above for the earlier embodiments are used for this embodiment to reference the same or similar components. As in the previous embodiments, each arm assembly 4 comprises a first arm or link 7 and a second arm or link 8. The first arm 7 is pivotally attached to the frame 402 via a first pivot joint 9 to pivot relative to the frame 402. The second arm 8 is pivotally attached to a support member 412 received on the frame via a second pivot joint 10 to pivot relative to the frame. The first and second arms 7, 8 are pivotally attached together by a third pivot joint 11. The third pivot joint 11 may have a pivot axis collinear with the rotational axis of the wheel 6.

The support member 412 is configured to move axially along the frame 402. The support member 412 couples the arm assemblies 4 together so that axial movement of the support member 412 towards and away from the wheels radially extends and retracts the wheels between a minimum diameter and a maximum diameter of the device 400.

Figure 4A:
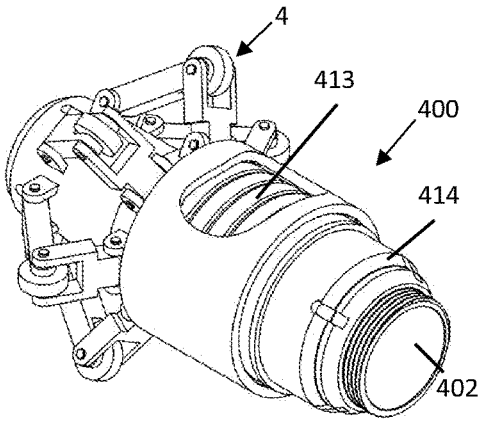
FIGS. 4A to 4D show a transportation device according to one embodiment of the present invention.
Figure 4B:
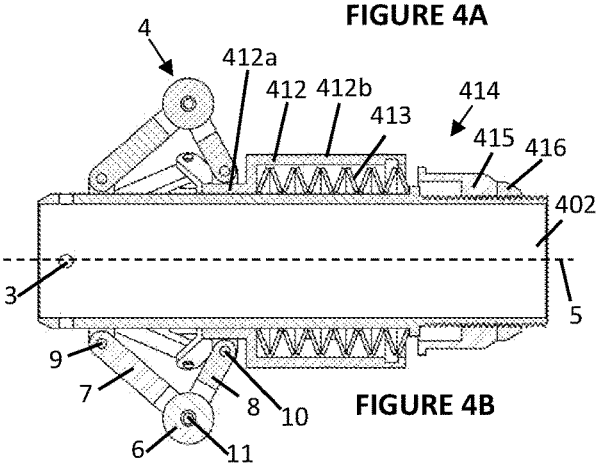
Figure 4C:
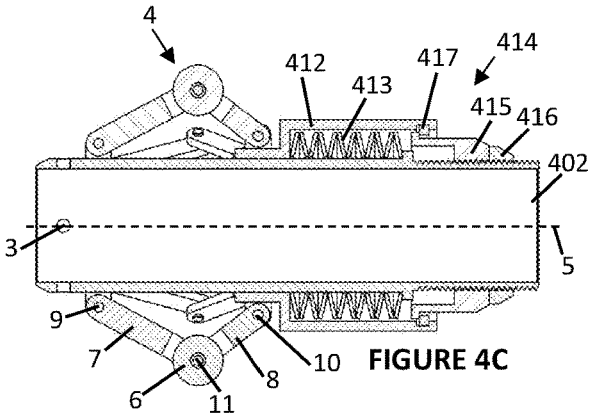
Figure 4D:
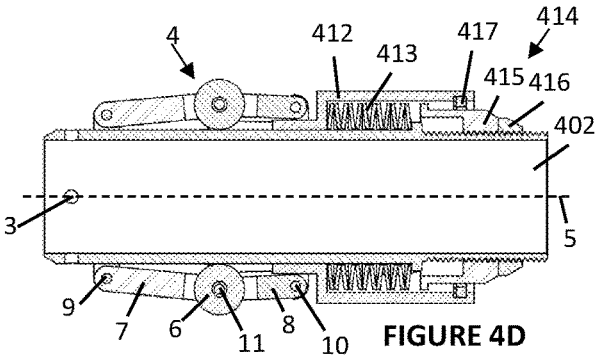

FIG. 4B shows the device with the arm assemblies 4 and spring elements 413 in the unloaded position. FIG. 4C shows the device with wheels 6 at the pre-set maximum outer diameter position, with the spring elements 413 preloaded, so that the arm assemblies 4 and spring elements 413 support the weight of the tool string, as described above with reference to the earlier embodiments. FIG. 4D shows the wheels 6 at the inner most radial position at a minimum outer diameter of the device. Should the device 400 encounter a wellbore restriction, the weight of the tool string acting axially on the wheels causes the wheels to be forced inwards against the bias provided by the spring elements 413 to allow the device to pass through the restriction, again as described above with reference to the earlier embodiment.

The adjustable mechanical stop mechanism 414 comprises a stop component 415 moveably coupled to the frame 402 to move axially along the frame 402. In a set position as shown in FIG. 4C, the stop component 415 engages the support member 412 to prevent axial movement of the support member towards the wheels 6, to set the pre-set maximum outer diameter of the device 400. The stop component 415 continues to allow axial movement of the support member 412 axially away from the wheels 6, to allow the wheels 6 to collapse radially inwards when encountering a wellbore restriction.

In the embodiment of FIGS. 4A to 4D, the stop component 415 is a collar received on the frame 402. A threaded engagement is provided between the stop component 415 and the frame 402. The stop component has an internal thread and the frame has a corresponding external thread.

The threaded engagement allows the stop component 415 to move axially along the frame 402 by relative rotation between the component and the frame. A locking mechanism may be provided to lock the stop component in the set position to prevent the stop component moving during use. For example, a lock nut or collar 416 is provided to prevent the stop component from unthreading. An abutment surface on the stop component engages a corresponding abutment surface on the support member to set the pre-set maximum outer diameter for the device 400. The load on the spring elements 413 must be increased in order to separate the corresponding abutment surfaces and move the arm assemblies with wheels 6 radially inwards from the pre-set maximum outer diameter. In the illustrated embodiment, the stop component abutment surface is provided by a shoulder on the stop component 415, and the support member abutment surface is provided by a shoulder presented by a split ring or collet 417 received on the support member 412, to allow the parts to be assembled together.

The spring elements 413 are arranged axially to bias the support member 412 axially towards the wheels 6, to bias the arm assemblies with wheels 6 radially outwards. The support member 412 is a collar that has a first section 412*a* sliding on the outside diameter of the frame 402 and a second section 412*b* extending over the spring elements 413 to house the spring elements 413 between the support member 412 and the frame 402. The spring elements 413 are loaded in compression between a shoulder on the frame 402 and a shoulder on the support member 412. The shoulder on the support member 412 extends between the smaller diameter first section 412*a* of the support member and the larger diameter second section 412*b* of the support member. The spring elements 413 are compressed in or order to separate the support member 412 and stop component 415 abutment surfaces and move the arm assemblies with wheels radially inwards from the pre-set maximum outer diameter. In the illustrated embodiment, the one or more spring elements 413 is a stack of Belleville washers.

Figure 5A:
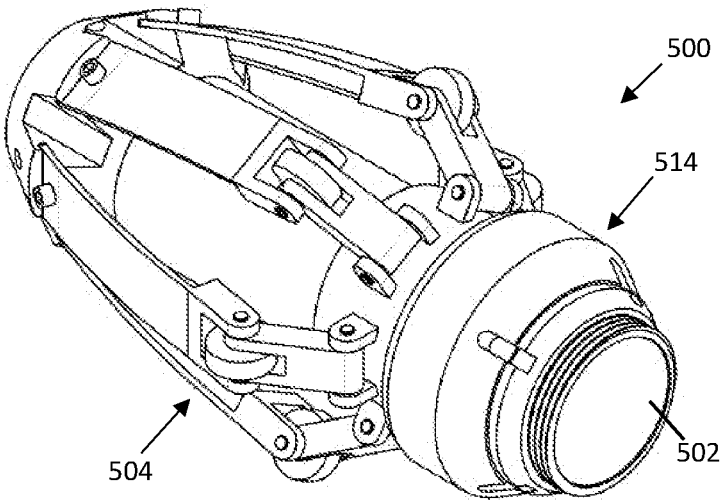
FIGS. 5A to 5G show a transportation device according to one embodiment of the present invention.
Figure 5B:
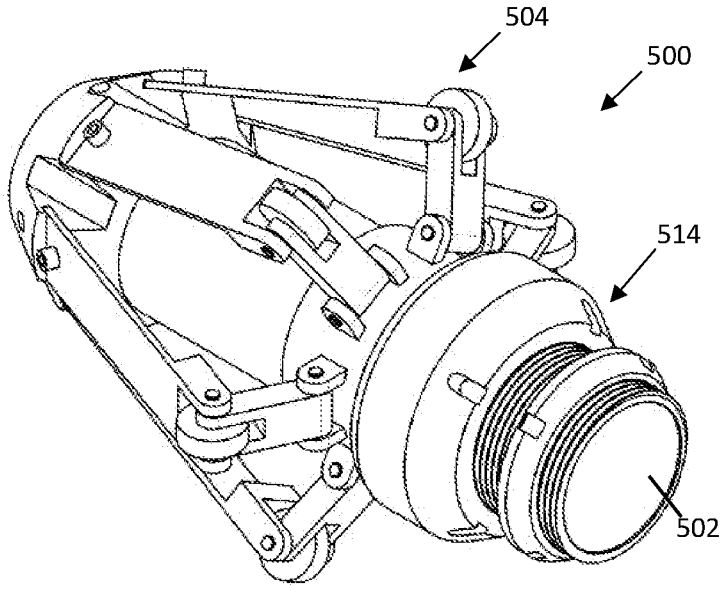
Figure 5C:
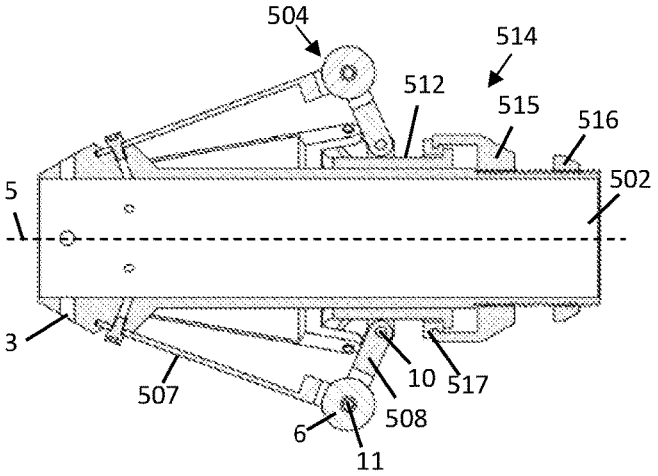
Figure 5E:
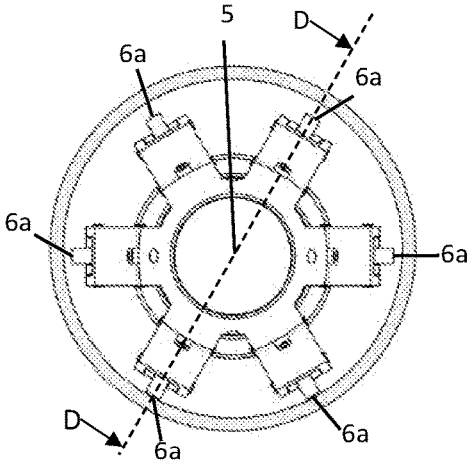
Figure 5D:
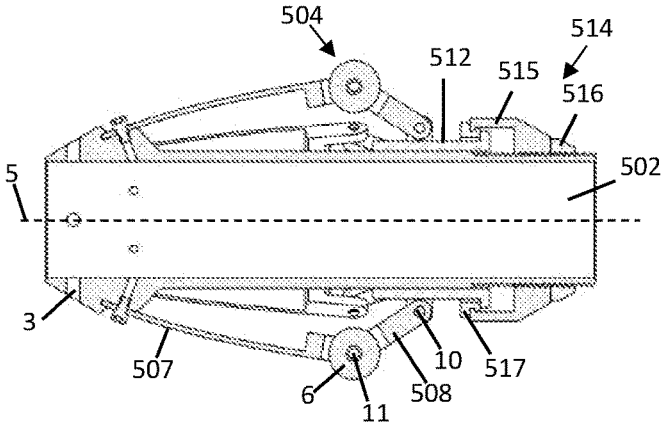
Figure 5G:
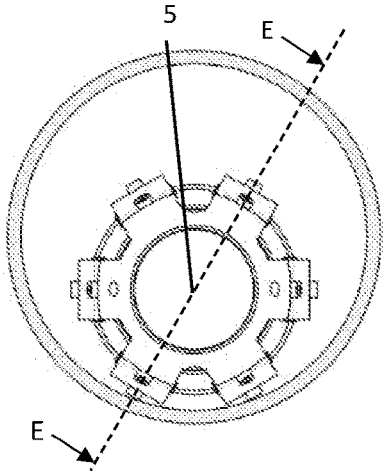
Figure 5F:
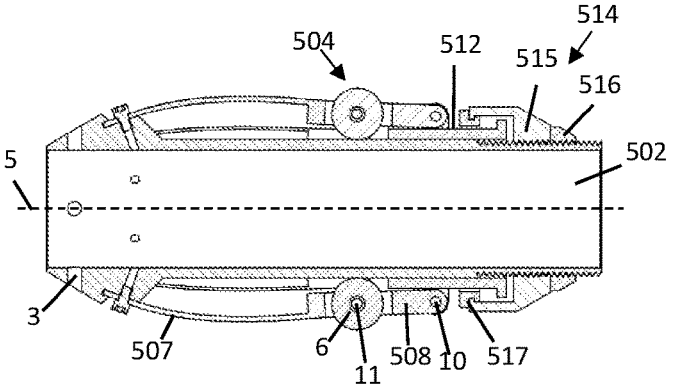

FIGS. 5A to 5G illustrate another embodiment of a transportation 500 device according to the present invention. The device 500 comprises a plurality of arm assemblies 504 azimuthally spaced apart around the longitudinal axis of the device 500. In the illustrated embodiment there are six arm assemblies 504, however the device may have three, four, five, six or more arm assemblies. Each arm assembly 504 is configured to move between a radial inward position and a radial outward position. FIGS. 5D and 5E show the arm assemblies 504 in a radially outward position, and FIGS. 5F and 5G show the arm assemblies 504 in a radially innermost position.

Each arm assembly 504 comprises a first arm or link 507, a second arm or link 508 and a wheel 6. An outside diameter of the wheel 6 defines a radially outermost extent or radial extremity of the device. Each wheel 6 is mounted to rotate on a rotational axis to present a low friction interface when in contact with the wellbore wall. The rotational axis of each wheel is perpendicular to the longitudinal axis of the device so that the device is carried on two or more wheels when in contact with the wellbore wall.

The first arm 507 is configured as a cantilever spring element, with an inner end of the first arm 507 fixed to the frame 502. The second arm 508 is pivotally attached at an inner end to a support member 512 received on the frame 502 via a pivot joint 10, to pivot relative to the support member 512. The first and second arms 507, 508 are pivotally attached together by a second pivot joint 11 at or adjacent outer ends of the first and second arms 507, 508. The second pivot joint 11 may have a pivot axis collinear with the rotational axis of the wheel 6 of the arm assembly 504.

The support member 512 is configured to move axially along the frame 502. The support member 512 couples the arm assemblies 504 together so that axial movement of the support member 512 towards and away from the wheels 6 radially extends and retracts the wheels 6 between a minimum diameter and a maximum diameter of the device. The wheels move between the minimum and maximum diameters by pivoting of the second arm 508 about the first pivot joint 10 and elastic bending of the first arm 507.

The elastically deformable first arms 507 provide a plurality of spring elements that bias the wheels 6 radially outwards. FIGS. 5B and 5C show the arm assemblies with wheels 6 in a radially outward position with the first arms 507 in an unloaded (elastically undeformed) state. With the arms 507 in the unloaded state, the wheels 6 are in the radially outermost unbiased or unloaded position, with the wheels 6 presenting the unbiased or unloaded outer diameter of the device 500. When in the unloaded state, the arms 507 may be straight. When the wheels 6 are moved radially inwards, the arms 507 elastically bend, to provide a spring preload to bias the wheels 6 radially outwards.

The transportation device 500 comprises a mechanical stop mechanism 514 to limit the radial outward movement of the arm assemblies with wheels to the set or operational maximum radial position to present the pre-set or operating maximum outer diameter for the device 500, as shown in FIGS. 5E and 5F. As described earlier, the pre-set maximum outer diameter is less than the unloaded outer diameter so that the arm assemblies are force biased outwards when in the set maximum radial position. When the arm assemblies are in the set maximum radial position, the elastic deformation or bending of the first arms presents a spring preload to each wheel. The spring preload is sufficient to support the weight of the device 500 and the tool string 101, so that the wheels 6 remain at the pre-set maximum outer diameter of the device 500 as the device transports the tool string 101 along the well bore even when in deviated sections of the wellbore, with the tool string carried on wheels of the device. As described for earlier embodiments, preferably the pre-set maximum outer diameter is set to be slightly less than an inner diameter of the wellbore, as shown in FIG. 5E. Should the device 500 encounter a wellbore restriction, the wheels 6 are deflected radially inwards to or towards the minimum outer diameter of the device illustrated in FIGS. 5F and 5G.

The mechanical stop mechanism 514 is adjustable to provide an adjustable pre-set maximum outer diameter to allow the device 500 to be configured for use in a range of wellbore diameters, as described above for the earlier embodiments. The adjustable mechanical stop mechanism 514 comprises a stop component 515 moveably coupled to the frame to move axially along the frame. In a set position as shown in FIG. 5D, the stop component 515 engages the support member 512 to prevent axial movement of the support member towards the wheels, to set the pre-set maximum outer diameter of the device. The stop component continues to allow axial movement of the support member axially away from the wheels, to allow the wheels to collapse radially inwards when encountering a wellbore restriction.

In the embodiment of FIGS. 5A to 5G, the stop component 515 is a collar received on the frame 502. A threaded engagement is provided between the stop component 515 and the frame 502. The threaded engagement allows the stop component 515 to move axially along the frame by relative rotation between the component 515 and the frame 502. The stop component 515 has an internal thread and the frame has a corresponding external thread. The threaded engagement allows the stop component to move axially along the frame by relative rotation between the component and the frame. A locking mechanism 516 may be provided to lock the stop component 515 in the set position to prevent the stop component moving during use. For example, a lock nut or threaded collar 516 is provided to prevent the stop component from unthreading. An abutment surface on the stop component engages a corresponding abutment surface on the support member to set the operational maximum outer diameter for the device 500. The load on the spring elements 507 must be increased by elastically deforming the first arms 507 further inwards towards the frame in order to separate the corresponding abutment surfaces and move the wheels 6 radially inwards from the pre-set maximum outer diameter. In the illustrated embodiment, the support member abutment surface is provided by a shoulder on the support member 512, and the stop component abutment surface is provided by a shoulder presented by a split ring or collet on the locking component 515, to allow the parts 512, 515 to be assembled together.

FIGS. 6A to 6G illustrate another embodiment of a transportation device according to the present invention. The device 600 comprises a plurality of bow springs 607 azimuthally spaced apart around the longitudinal axis of the device 600. In the illustrated embodiment there are six bow springs, however the device may have three, four, five, six or more bow springs. Each bow spring 607 is configured to move between a radial inward position and a radial outward position.

Each bow spring 607 supports a wheel 6. In the illustrated embodiment, the wheel 6 is supported at a central portion of the bow spring 607. An outside diameter of the wheel 6 defines a radially outermost extent or radial extremity of the device. Each wheel 6 is mounted to rotate on a rotational axis to present a low friction interface when in contact with the wellbore wall. The rotational axis of each wheel is perpendicular to the longitudinal axis of the device 600 so that the device is carried on two or more wheels when in contact with the wellbore wall.

Figure 6A:
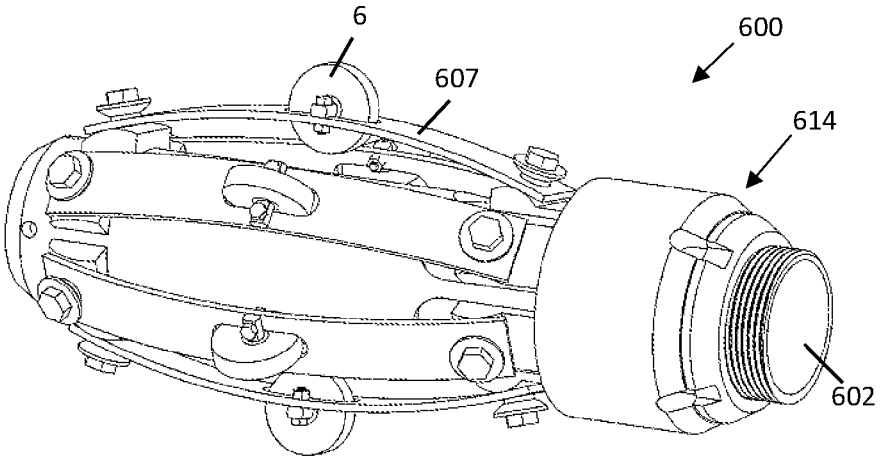
FIGS. 6A to 6G show a transportation device according to one embodiment of the present invention.
Figure 6B:
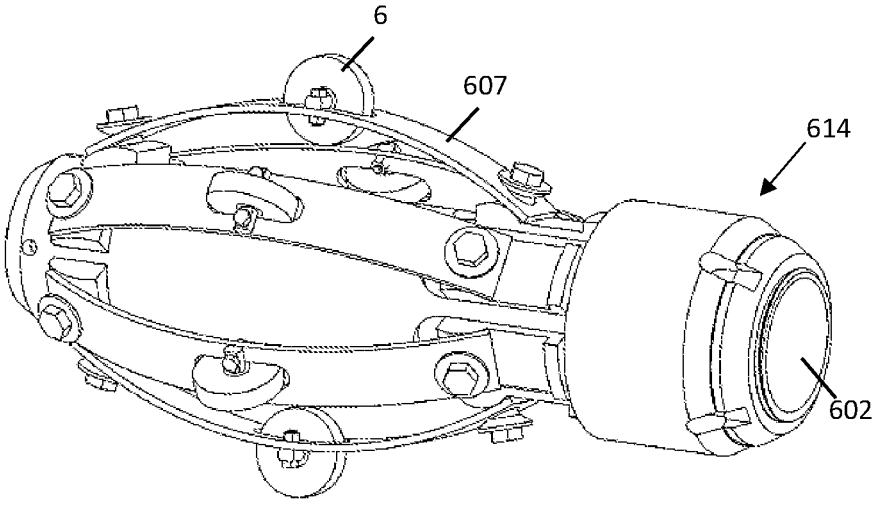
Figure 6C:
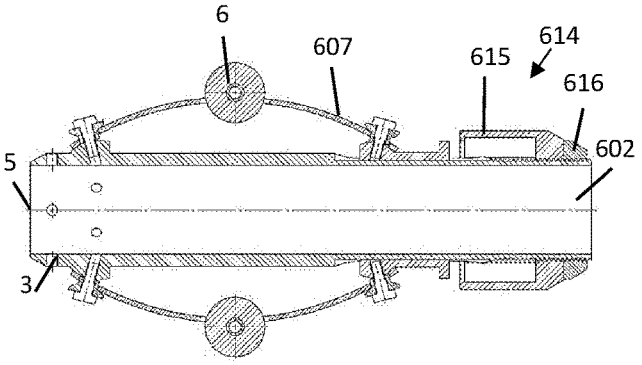
Figure 6E:
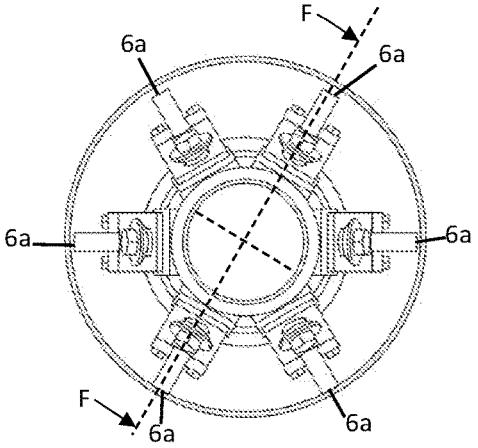
Figure 6D:
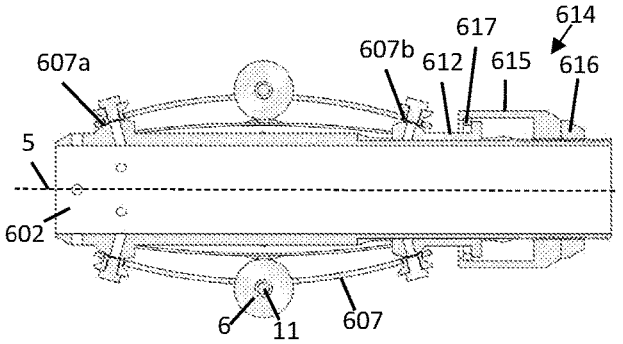
Figure 6G:
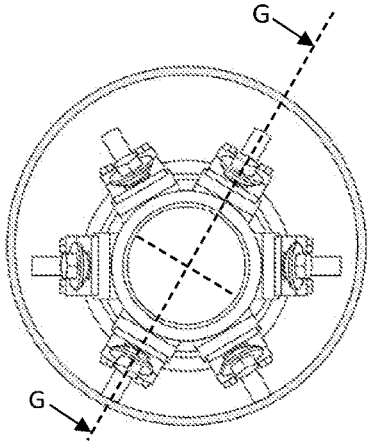
Figure 6F:
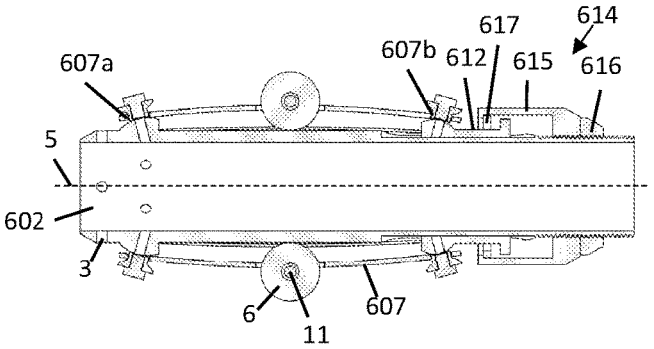

The outside diameter of the device is variable. The bow springs 607 moveably support the wheels 6 to move between a radial inward position and a radial outward position with respect to the longitudinal axis. FIGS. 6D and 6E show the bow springs in a radially outward position, and FIGS. 6F and 6G show the bow springs in a radially innermost position.

A first end 607*a* of each bow spring 607 coupled to the frame 602 and a second opposite end 607*b* of each bow spring is coupled to a support member 612 received on the frame 602. The support member 612 is configured to move axially along the frame 602. The support member 612 couples the bow springs 607 together so that axial movement of the support member towards and away from the wheels 6 causes the bow spring to be elastically deformed to deflect radially outwards and radially inwards to extend and retract the wheels 6 between a minimum diameter and a maximum diameter of the device.

The elastically deformable bow springs present a plurality of spring elements 607 to bias the wheels 6 radially outwards. FIGS. 6B and 6C show the bow springs in a radially outward position with the bow springs 607 in an unloaded (elastically undeformed) state. With the bow springs 607 in the unloaded state, the wheels 6 are in a radially outermost unbiased or unloaded position. In the radially outermost unbiased position, the wheels present an unbiased or unloaded outer diameter of the device 600. When the wheels 6 are moved radially inwards, the bow springs 607 elastically bend, to provide a spring preload to bias the wheels 6 radially outwards.

The transportation device 600 comprises a mechanical stop mechanism 614 to limit the radial outward movement of the wheels 6 to set a maximum radial position to present a pre-set or operating maximum outer diameter for the device, as shown in FIGS. 6D and 6E. As described earlier, the pre-set maximum outer diameter is less than the unloaded outer diameter so that the wheels 6 are biased outwards when the wheels 6 are at the pre-set maximum outer diameter. When the wheels 6 are at the pre-set maximum radial position, the bow springs 607 present a spring preload to the wheels 6. The spring preload is sufficient to support the weight of the device and the tool string, so that the wheels remain at the pre-set maximum outer diameter of the device as the device transports the tool string along the well bore even when in deviated sections of the wellbore, with the tool string 101 carried on wheels 6 of the device 600. As described for earlier embodiments, preferably the pre-set maximum outer diameter is set to be slightly less than an inner diameter of the wellbore, as shown in FIG. 6E. Should the device encounter a wellbore restriction, the wheels are deflected radially inwards to or towards the minimum outer diameter of the device 600 illustrated in FIGS. 6F and 6G.

The mechanical stop mechanism 614 is adjustable to provide an adjustable pre-set maximum outer diameter to allow the device 600 to be configured for use in a range of wellbore diameters, as described above. The adjustable mechanical stop mechanism 614 comprises a stop component 615 moveably coupled to the frame 602 to move axially along the frame 602. The stop mechanism 614 of the embodiment of FIGS. 6A to 6G is similar to the stop mechanism 515 described above with reference to FIGS. 5A to 5G. The stop mechanism comprises a stop component (threaded ring or collar) to limit axial movement of the support member 612. FIG. 6D shows the stop component 615 in the set position engaging the support member 612 to prevent axial movement of the support member 612 towards the wheels 6, to set the pre-set maximum outer diameter of the device 600. The stop component 615 continues to allow axial movement of the support member 612 axially away from the wheels 6, to allow the wheels 6 to collapse radially inwards when encountering a wellbore restriction. In the illustrated embodiment, the support member 612 abutment surface is provided by a shoulder on the support member 612, and the stop component abutment surface is provided by a shoulder presented by a split ring or collet 617 on the stop component 612, to allow the parts to be assembled together.

In the above described embodiments 200, 300, 400, 500, 600, the arm assemblies 4, 504 or bow springs 607 are coupled together via the support member 12, 412, 512, 612 so that, when one wheel 6 is pushed inwards when encountering a wellbore restriction, all of the wheels 6 are moved radially inwards together. Once the device as traversed past a wellbore restriction, all wheels 6 carried by the arm assemblies or bow springs move radially outwards together, to return to the pre-set maximum outer diameter of the device 200, 300, 400, 500, 600.

In some embodiments, the wheels may be movably supported to move between a radially inward position and a radially outward position with respect to the longitudinal axis independently of the other wheels. In such embodiments, the wheels can move independently between the minimum outer diameter of the device and the maximum diameter of the device. The minimum outer diameter of the device is defined by the wheels when all wheels are at the radially inward position. The maximum outer diameter of the device is defined by the wheels when all wheels are at the radially outward position.

Figure 7A:
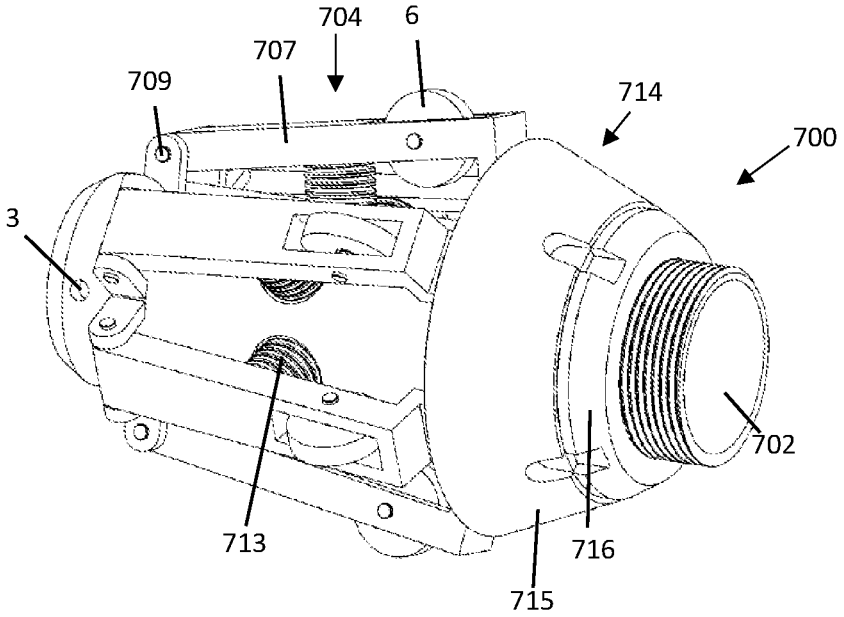
FIGS. 7A to 7G show a transportation device according to one embodiment of the present invention.
Figure 7B:
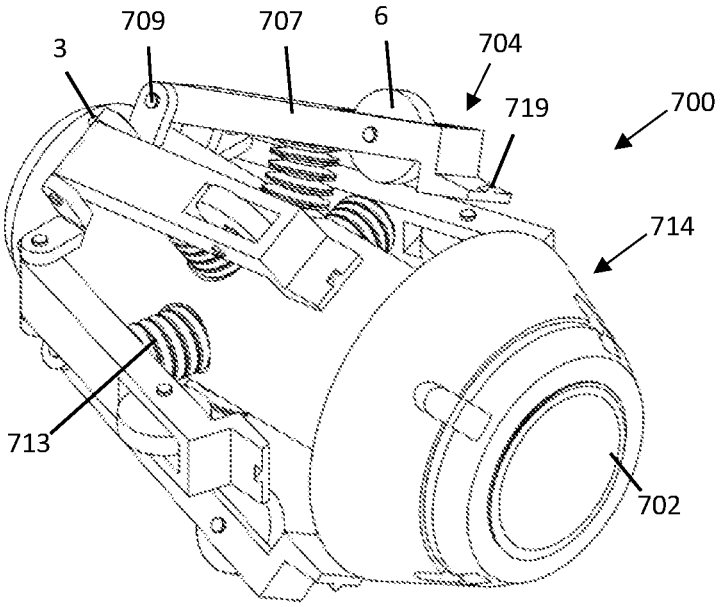
Figure 7C:
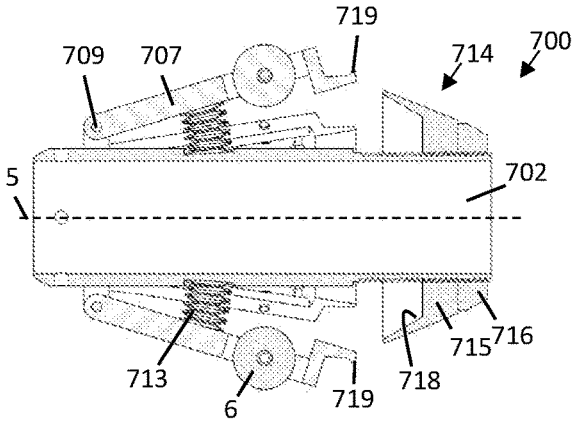
Figure 7E:
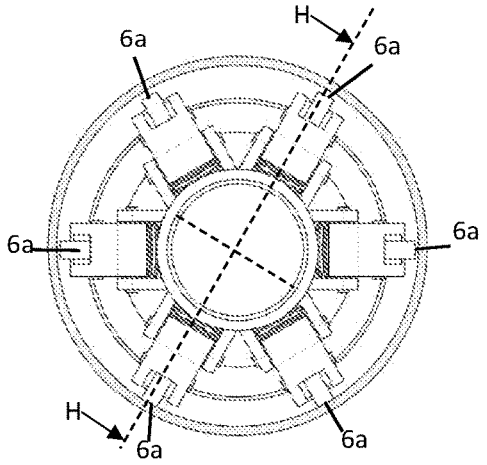
Figure 7D:
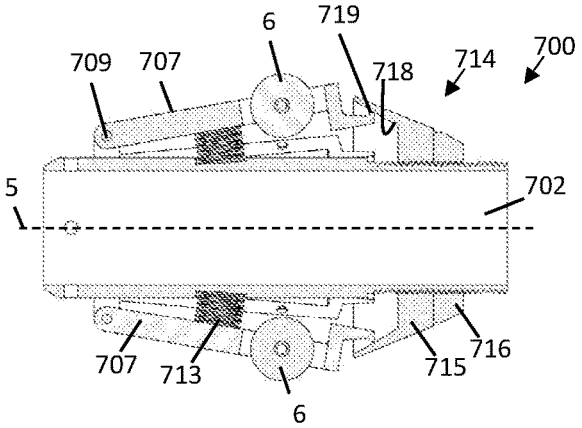
Figure 7G:
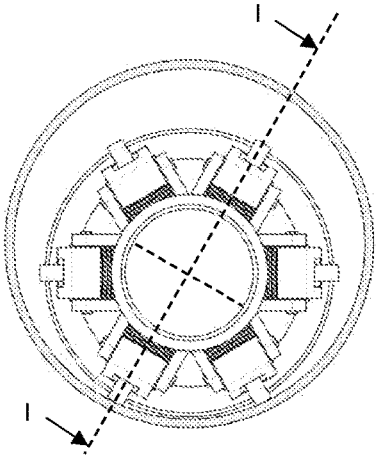
Figure 7F:
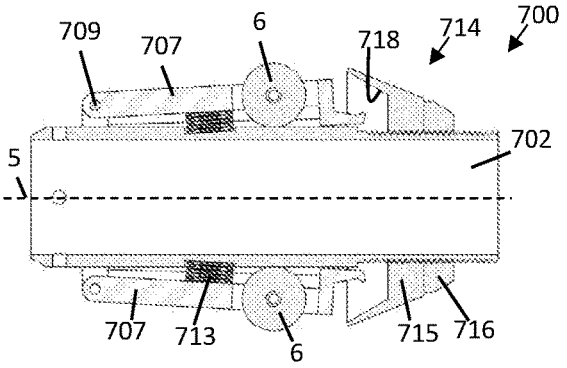

FIGS. 7A to 7F illustrate another embodiment of a transportation device according to the present invention. The device 700 comprises a plurality of arm assemblies 704 azimuthally spaced apart around the longitudinal axis 5 of the device 700. In the illustrated embodiment there are six arm assemblies 704, however the device may have three, four, five, six or more arm assemblies. Each arm assembly 704 is configured to move between a radial inward position and a radial outward position, and therefore to move between the minimum outer diameter and the maximum outer diameter of the device. FIGS. 7D and 7E show the arm assemblies in a radially outward position with the wheels positioned at the maximum outer diameter of the device, and FIGS. 7F and 7G show the arm assemblies in a radially innermost position with the wheels positioned at the minimum outer diameter of the device.

Each arm assembly 704 comprises an arm 707 and a wheel 6. An outside diameter of the wheel 6 defines a radially outermost extent or radial extremity of the device. Each wheel is mounted to rotate on a rotational axis to present a low friction interface when in contact with the wellbore wall. The rotational axis of each wheel 6 is perpendicular to the longitudinal axis of the device so that the device is carried on two or more wheels when in contact with the wellbore wall.

An inner end of the arm 707 is pivotally attached to the mandrel or frame 702 via a pivot joint 709 to pivot relative to the frame 702. The wheel 6 is mounted adjacent to an outer end of the arm 707. Each arm pivots about the pivot joint 709 to move the wheel 6 between the minimum diameter and the maximum diameter of the device. An outer end of the arm 707 is a free end of the arm, that is, the outer end of the arm is uncoupled from the other arms 707. Thus, each arm 707 pivots or hinges about the pivot joint 709 and therefore can pivot independently of the other arms 707.

A plurality of spring elements 713 biases the arms 707 radially outwards and therefore the wheels 6 radially outwards. The spring elements 713 are azimuthally spaced apart around the longitudinal axis. Each spring element 713 biases a respective arm 707, and acts between the frame 702 and a respective arm 707. The spring elements are coil springs arranged radially. However, one skilled in the art will understand other spring elements are possible, such as leaf springs acting between each arm and the frame. FIGS. 7B and 7C show the arm assemblies in a radially outward position with the spring(s) in an unloaded (elastically undeformed) state. With the springs in the unloaded state, the wheels 6 are in the radially outermost unbiased or unloaded position. In the radially outermost unloaded position, the wheels 6 present an unbiased or unloaded outer diameter of the device.

The transportation device 700 comprises a mechanical stop mechanism 714 to limit the radial outward movement of the wheels 6 to set the maximum radial position to present the pre-set or operating maximum outer diameter for the device, as shown in FIGS. 7D and 7E. As described earlier, the pre-set maximum outer diameter is less than the unloaded outer diameter so that the wheels 6 are biased to force outwards when the wheels 6 are at the pre-set maximum outer diameter. When the wheels 6 are at the pre-set maximum outer diameter, the spring elements 713 presents a spring preload to the wheels 6 via the respective arm 707. The spring preload is sufficient to support the weight of the device and the tool string, so that the wheels remain at the pre-set maximum outer diameter of the device as the device 700 transports the tool string 101 along the well bore even when in deviated sections of the wellbore, with the tool string carried on wheels of the device. As described for earlier embodiments, preferably the pre-set maximum outer diameter is set to be slightly less than an inner diameter of the wellbore, as shown in FIG. 7E. Should the device encounter a wellbore restriction, the wheels are deflected radially inwards to or towards the minimum outer diameter of the device illustrated in FIGS. 7F and 7G. However, unlike the above described transportation devices, each arm 707 and therefore wheel 6 can move independently of the other arms 707 and wheels 6. Only one, or some, of the springs may need to be deflected to push the device through a restriction.

The mechanical stop mechanism 714 is adjustable to provide an adjustable pre-set maximum outer diameter to allow the device to be configured for use in a range of wellbore diameters, as described above for earlier embodiments. The adjustable mechanical stop mechanism 714 comprises a stop component 715 moveably coupled to the frame 702 to move axially along the frame. In a set position as shown in FIG. 7D, the stop component engages the arms to prevent radial outward movement of the arms, to set the pre-set maximum outer diameter of the device. The stop component continues to allow radial inward movement of the arms 707 to allow the wheels to collapse radially inwards when encountering a wellbore restriction.

In the illustrated embodiment, the stop component 715 is a collar received on the frame 702. A threaded engagement is provided between the stop component 715 and the frame 702. The stop component 715 has an internal thread and the frame 702 has a corresponding external thread. The threaded engagement allows the stop component 715 to move axially along the frame by relative rotation between the component and the frame. A locking mechanism 716 may be provided to lock the stop component 715 in the set position to prevent the stop component moving during use. For example, a lock nut or collar 716 is provided to prevent the stop component from unthreading. An abutment surface on the stop component engages a corresponding abutment surface on each arm to set the pre-set maximum outer diameter for the device. In this embodiment, the stop component presents a radially inwardly facing abutment surface 718 to engage a radially outwardly facing abutment surface 719 of each arm. The radially inwardly facing surface 718 is inclined to the longitudinal axis 5 of the device so that axial movement of the stop component 715 changes the pre-set maximum outer diameter of the device. The inclined surface 718 may be conical/frustoconical. The load on the spring elements 713 must be increased in order to separate the corresponding abutment surfaces 718, 719 and move the arm assemblies 704 radially inwards from the pre-set maximum outer diameter.

Figure 8A:
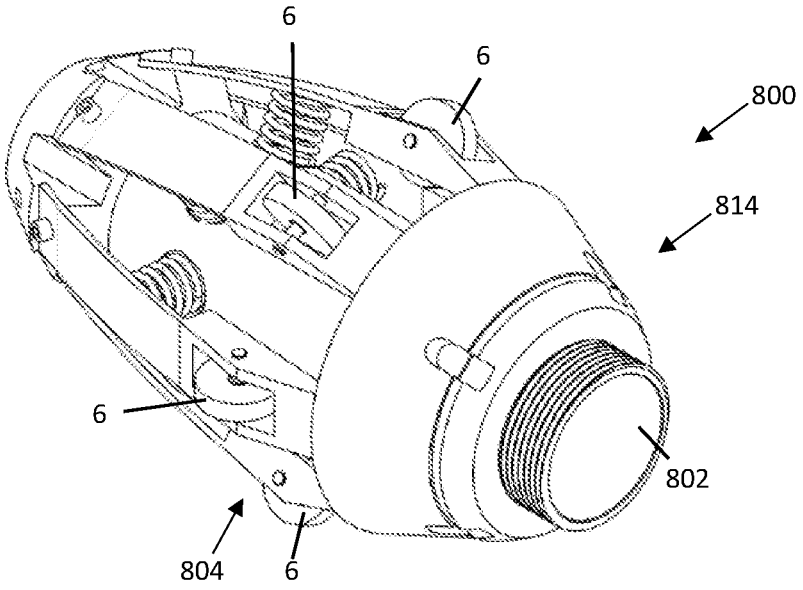
FIGS. 8A to 8E show a transportation device according to one embodiment of the present invention.
Figure 8B:
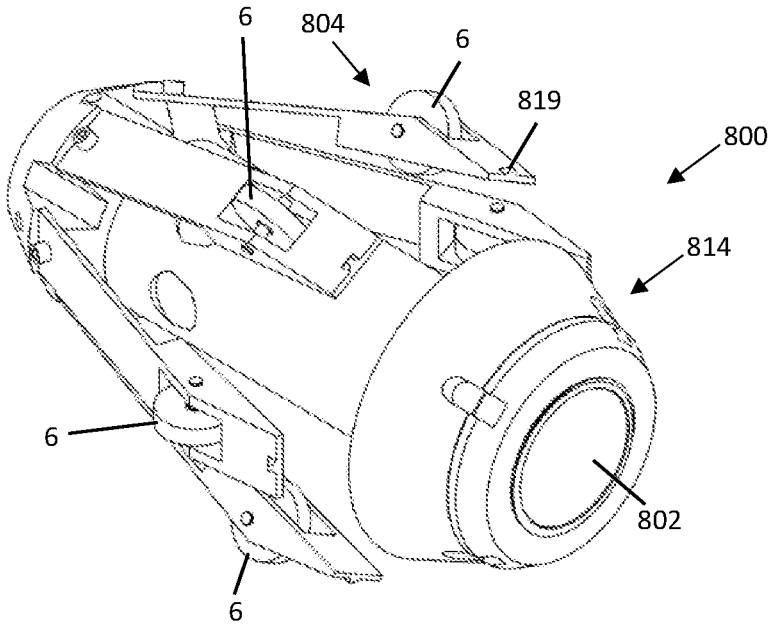
Figure 8C:
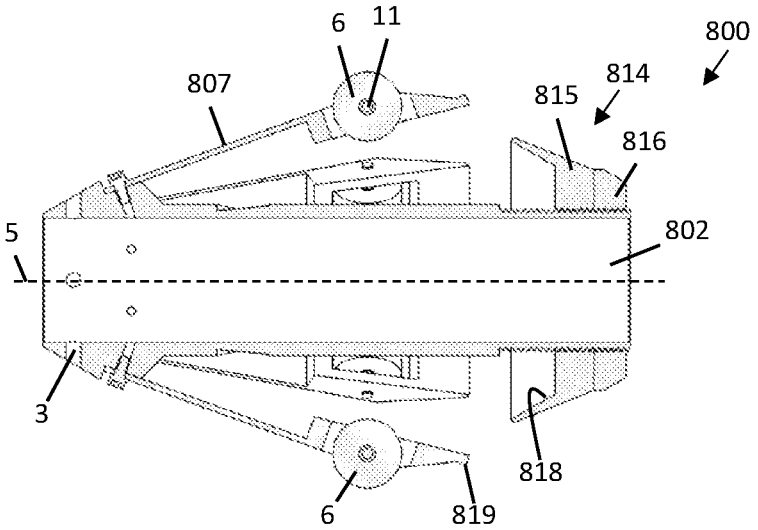
Figure 8D:
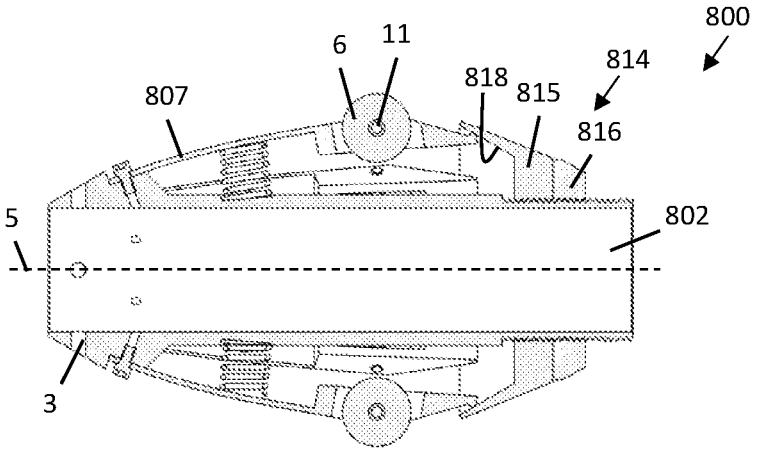
Figure 8E:
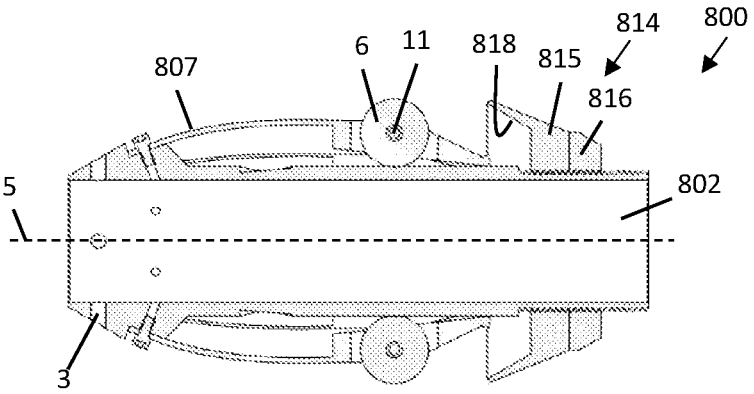
Figure 9A:
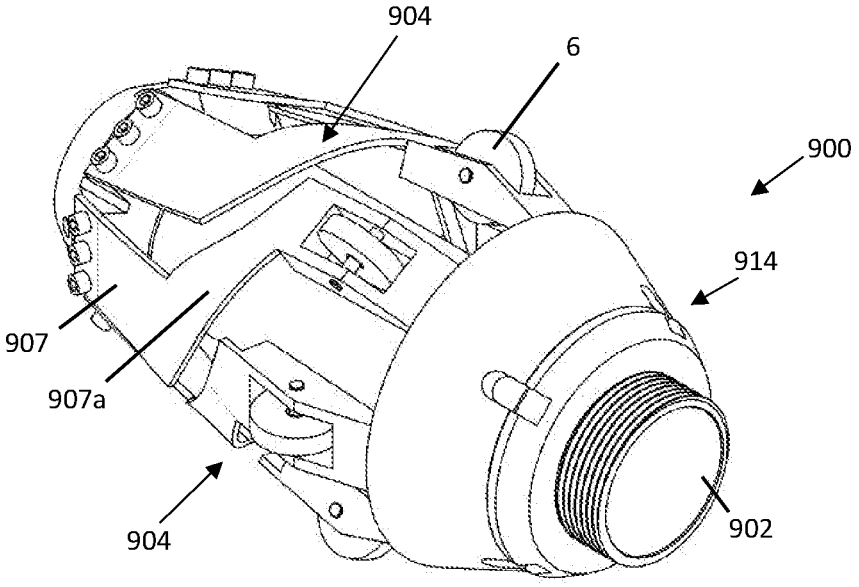
FIGS. 9A to 9E show a transportation device according to one embodiment of the present invention.
Figure 9B:
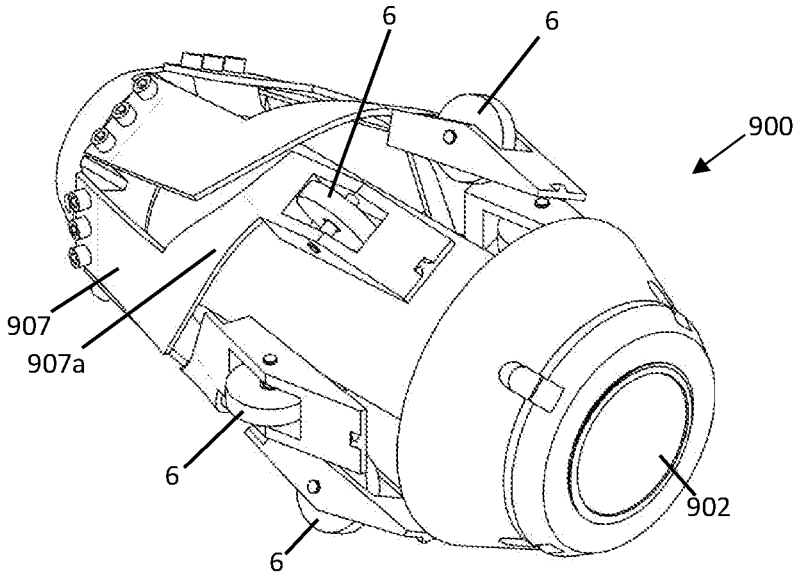
Figure 9C:
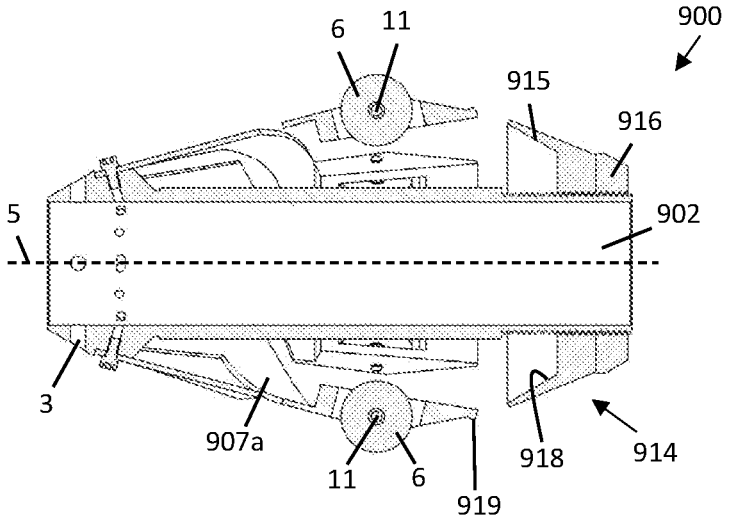
Figure 9D:
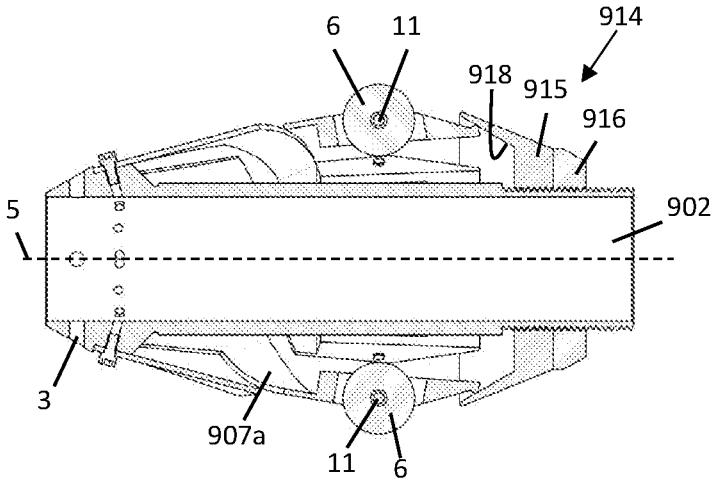
Figure 9E:
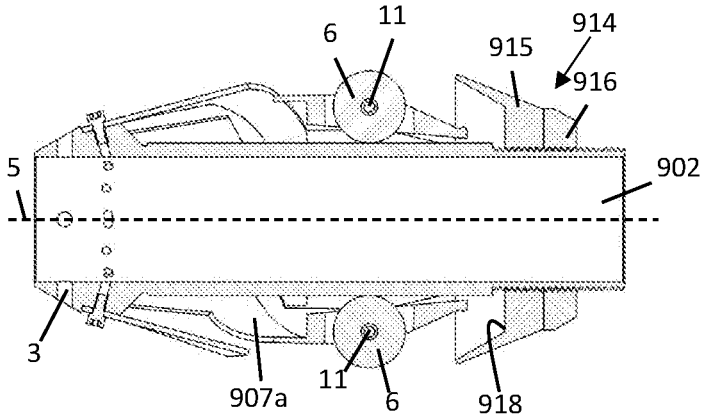

FIGS. 8A to 8F illustrate another embodiment of a transportation device according to the present invention. The device 800 comprises a plurality of arm assemblies 804 azimuthally spaced apart around the longitudinal axis of the device. In the illustrated embodiment there are six arm assemblies 804 (two arm assemblies obscured from view in FIGS. 8A and 8B), however the device may have three, four, five, six or more arm assemblies. Each arm assembly 804 is configured to move between a radial inward position and a radial outward position. FIG. 8D shows the arm assemblies in a radially outward position, and FIG. 8E shows the arm assemblies in a radially innermost position.

Each arm assembly 804 comprises an arm 807 and a wheel 6. An outside diameter of the wheel 6 defines a radially outermost extent or radial extremity of the device. Each wheel 6 is mounted to rotate on a rotational axis to present a low friction interface when in contact with the wellbore wall. The rotational axis of each wheel 6 is perpendicular to the longitudinal axis of the device 800 so that the device is carried on two or more wheels when in contact with the wellbore wall.

The arm 807 is configured as a cantilever spring element, with an inner end of the arm 807 fixed to the frame 802. The wheel 6 is mounted to the arm 807 adjacent to an outer end of the arm 807. The wheels 6 move between the minimum and maximum diameters of the device by elastic bending of the arms 807. The outer end of the arm is a free end of the arm 807, that is, the outer end of the arm is uncoupled from the other arms 807. Thus, each arm 807 elastically bends independently of the other arms 807.

The elastically deformable arms provide a plurality of spring elements 807 that bias the wheels 6 radially outwards. FIGS. 8B and 8C show the arm assemblies 807 with wheels 6 in a radially outward position with the arms in an unloaded (elastically undeformed) state. With the arms in the unloaded state, the wheels are in the radially outermost unbiased or unloaded position, with the wheels presenting the unbiased or unloaded outer diameter of the device 800. When in the unloaded state, the arms 807 may be straight. When the wheels 6 are moved radially inwards, the arms 807 elastically bend, to provide a spring preload to bias the wheels 6 radially outwards.

The transportation device comprises a mechanical stop mechanism 814 to limit the radial outward movement of the wheels 6 to set the maximum radial position to present the pre-set or operating maximum outer diameter for the device 800, as shown in FIG. 8D. As described earlier, the pre-set maximum outer diameter is less than the unloaded outer diameter so that the wheels 6 are biased outwards when the wheels are at the pre-set maximum outer diameter. When the wheels are at the pre-set maximum outer diameter, the spring elements 807 present a spring preload to the wheels. The spring preload is sufficient to support the weight of the device and the tool string, so that the wheels remain at the pre-set maximum outer diameter of the device as the device 800 transports the tool string 101 along the well bore even when in deviated sections of the wellbore, with the tool string carried on wheels of the device. As described for earlier embodiments, preferably the pre-set maximum outer diameter is set to be slightly less than an inner diameter of the wellbore. Should the device encounter a wellbore restriction, the wheels 6 are deflected radially inwards to or towards the minimum outer diameter of the device illustrated in FIG. 8E. Each arm and therefore wheel can move independently of the other arms 707 and wheels 6. Only one, or some, of the arms may need to be deflected to push the device through a restriction.

The mechanical stop mechanism 714 is adjustable to provide an adjustable pre-maximum outer diameter to allow the device to be configured for use in a range of wellbore diameters. In the embodiment of FIGS. 8A to 8E, the stop mechanism 814 is the same as the stop mechanism 714 as described above with reference to FIGS. 7A to 7G, with the same parts referenced by the same reference numerals but for a change in prefix from 7 to 8.

In the embodiment of FIGS. 8A to 8E the cantilever spring elements 807 extend in a plane coincident with the longitudinal axis of the device 800.

FIGS. 9A to 9E illustrate another embodiment of a transportation device according to the present invention. In the embodiment of FIGS. 9A to 9E, the cantilever spring elements 907 include a portion that extends circumferentially around the longitudinal axis 5 of the device. As in the above described embodiment of FIGS. 8A to 8E, the wheels 6 move between the minimum and maximum diameters of the device by elastic bending of the arms or spring elements 907. However, due to the circumferential portion 907*a* of the arms 907, the arms 907 elastically deform in bending and torsion. The circumferentially extending arms 907 achieve a longer arm length for a given axial length of the device, and therefore achieve a shorter length device, with the circumferentially extending arms nested or intertwined together around the longitudinal axis of the device. Other than this difference in the configuration of the cantilever spring elements, the embodiment of FIGS. 9A to 9E is much the same as the embodiment of FIGS. 8A to 8E, with the same parts referenced by the same reference numerals but for a change in prefix from 8 to 9.

Figure 10A:
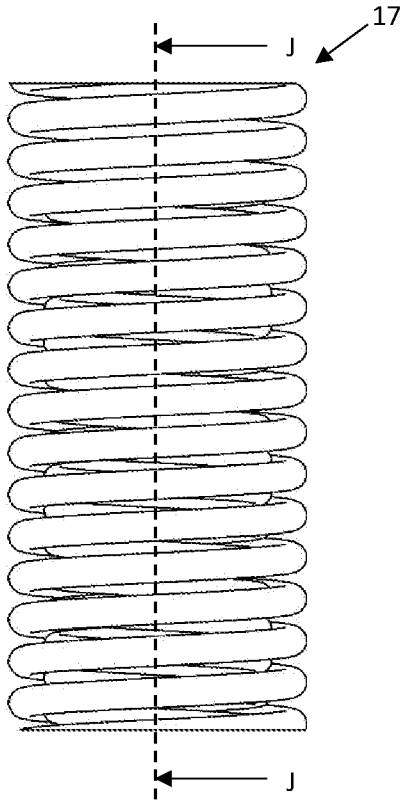
FIG. 10A shows a shorter spring inside a longer spring, to provide a variable or non-linear spring rate.
Figure 10B:
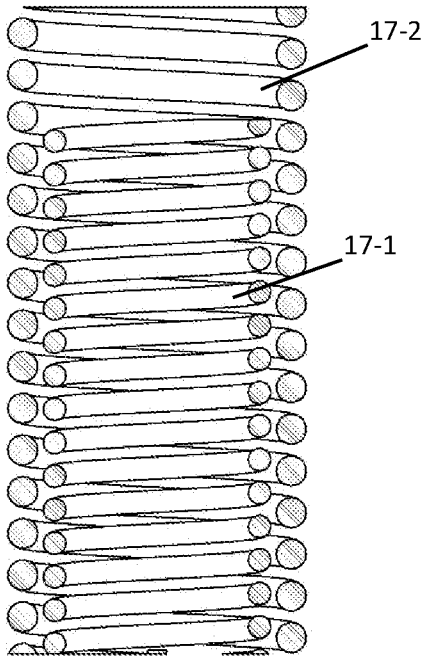
FIG. 10B is a sectional view on line J-J of the springs in FIG. 10A.
Figure 11:
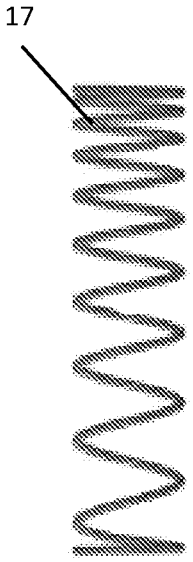
FIG. 11 shows a variable pitch coil spring configured to provide a variable or non-linear spring rate

The present invention has been described with reference to various embodiments 200, 300, 400, 500, 600, 700, 800, 900 by way of example. One skilled in the art will understand that modifications may be made without departing from the invention, including combinations of parts from the various embodiments described above. For example, while the embodiments 200, 300, 400 of FIGS. 2A to 4D have been described as incorporating axial arranged spring elements, one skilled in the art will appreciated that these embodiments may be implemented alternatively or additionally with radially acting springs arranged between the arms 7 or 8 and the frame 2 of the device. For example, the described embodiments may additionally or alternatively comprise leaf springs acting between the arm assemblies and the frame 2. Likewise, one or more axially arranged spring elements may be added to act on a support member coupling the arm assemblies or bow springs together in the embodiments 500, 600 of FIGS. 5A to 6G, for example, using the spring arrangement of the embodiment 400 of FIGS. 4A to 4D. A transportation device according to the present invention may have only axial springs, only radial springs, or a combination of both axial and radial springs. In some embodiments, a combination of two or more spring devices may also be used, for example one or more springs may be provided end-to-end to impart a combined non-linear spring rate. Alternatively, a shorter coil spring may be placed inside or outside a longer coil spring, as shown in FIG. 10, to impart a combined non-linear rate. The shorter spring 17-1 may be wound in an opposite direction to the longer spring 17-2. The inner and outer springs 17-1, 17-2 are preferably concentric. The longer spring biases the wheels radially outwards at large angles between the longitudinal axis and an arm of the arm assembly where the mechanical advantage provided by the arm assembly is increased. As the longer spring is compressed as the wheels move radially inwards, the shorter spring is engaged in addition to the longer spring to provide an increased spring force at low angles between the longitudinal axis and an arm of the arm assembly where the mechanical advantage provided by the arm assembly is reduced. Alternatively, the pitch of the coil spring may vary over its length to provide a non-linear or variable spring rate. A variable pitch spring is shown in FIG. 11. A variable rate spring may be applied axially to the sliding support members and/or radially to each arm assembly, to provide an increased spring force at small angles between the longitudinal axis and an arm of the arm assembly where the mechanical advantage provided by the arm assembly is reduced, and a decreased spring force at large angles between the longitudinal axis and an arm of the arm assembly where the mechanical advantage is increased. A non-linear spring arrangement, such as those described above, may be designed so that the non-linear spring rate in combination with the varying mechanical advantage provided by the arm assemblies achieves a constant radial force for a range of well bore diameters.

In the embodiments 200, 300, 400, 500 the arm assemblies are coupled together via a support member that moves axially along the frame. One end of each arm assembly is pivotally attached to the support member, and an opposite end of each arm assembly is pivotally attached to the frame. However, in some embodiments, both ends of the arm assemblies may be coupled to respective support members configured to move axially along the frame. For example, in an alternative embodiment to the arrangement illustrated in FIGS. 2A to 2G, the first arm 7 may be pivotally attached to a first support member received on the frame 2 via a first pivot joint at or adjacent an inner end of the first arm, and the second arm 8 may be pivotally attached to a second support member received on the frame 2 via a second pivot joint at or adjacent an inner end of the second arm, with the first and second arms pivotally attached together by a third pivot joint at or adjacent an outer end of each arm. The first and second support members are configured to move axially along the frame, so that axial movement of one or both of the first and second support members radially extends and retracts the wheels 6 between the minimum diameter and the maximum diameter of the device. A first one or more spring elements biases the first support member towards the wheels, and a second one or more spring elements biases the second support member towards the wheels.

The present invention described by way of example with reference to various embodiments 200, 300, 400, 500, 600, 700, 800, 900 provides a transportation device that is configured in a way to provide one or more of the following benefits. The device can be configured to carry a tool string centrally within a wellbore and/or to provide a low friction interface between the tool string and the well bore wall. A device according to the present invention is configured to provide an adjustable pre-set maximum outer diameter. If the pre-set maximum outer diameter is set to be equal to or slightly less than an inner diameter of the wellbore, the device is configured to carry the tool string centrally within the wellbore. By setting the pre-set maximum outer diameter of the device to be equal to or slightly less than the wellbore inner diameter, the device presents a low friction interface between the tool string and the wellbore wall, since the tool string is carried on only two wheels of the device and/or the wheels of the device are not forced against opposite sides of the wellbore wall by springs biasing the wheels radially outwards. Additionally, since the wheels of the device can move radially inwards, the device is configured to pass through wellbore restrictions, even while presenting the low friction and/or centering benefits described above. Furthermore, the device is a passive device, with energisation of the wheels radially outwards being provided by the one or more spring elements of the device only. No other power input, such as electrical or hydraulic power provided from surface located power units is required. The invention therefore provides a lower cost, effective, and simplified device that provides improved operational reliability and accuracy of logged data.

The invention has been described with reference to transporting a tool string in a wellbore during a wireline logging operation. However, a transportation device according to the present invention may be used for transporting a sensor assembly in a bore in other applications, for example to carry and center a camera in a pipe for inspection purposes.

Although this invention has been described by way of example and with reference to possible embodiments thereof, it is to be understood that modifications or improvements may be made thereto without departing from the spirit or scope of the appended claims.

The invention claimed is:

1. A device for transporting a sensor assembly in a bore, the device comprising:

a plurality of wheels azimuthally spaced apart around a longitudinal axis of the device, each wheel presenting a radial extremity of the device, the wheels moveably supported to move between a minimum outer diameter of the device and a maximum outer diameter of the device;

an adjustable stop mechanism configured to pre-set the maximum outer diameter of the device within a range of maximum outer diameters so that the device is configurable for use in a pre-determined range of bore diameters, wherein the adjustable stop mechanism is configured to pre-set the maximum outer diameter of the device so that the wheels contact the bore wall on only one side of the bore; and one or more spring elements to bias the wheels radially outwards, and wherein the one or more spring elements are preloaded to provide a radial force to the wheels when at the pre-set maximum outer diameter.

2. A device as claimed in claim 1, wherein the one or more spring elements is configured to bias the wheels radially outwards to a radially outermost unloaded position at an unloaded outer diameter of the device; and wherein the pre-set maximum outer diameter is smaller than the unloaded outer diameter so that the one or more spring elements are preloaded to provide the radial force to the wheels when at the pre-set maximum outer diameter.

3. The device as claimed in claim 1, wherein the outer diameter range corresponds to a range of bore diameters so that the pre-set maximum outer diameter is settable to be slightly less than a bore diameter.

4. The device as claimed in claim 1, wherein the adjustable stop mechanism is configured to pre-set the maximum outer diameter of the device so that the device supports the sensor assembly as it traverses along a bore without contacting opposite sides of the bore.

5. The device as claimed in claim 1, wherein the outer diameter range corresponds to a range of nominal wellbore diameters relating to a range of wellbore casing weights for a nominal wellbore casing diameter.

6. The device as claimed in claim 1, wherein the adjustable stop mechanism comprises a stop component and a threaded engagement configured to pre-set the maximum outer diameter of the device within the outer diameter range.

7. The device as claimed in claim 1, wherein the one or more spring elements are preloaded to provide the radial force to the wheels when at the pre-set maximum outer diameter so that the device supports the sensor assembly at the pre-set maximum diameter as it traverses along a bore.

8. The device as claimed in claim 1, wherein the device is configured to carry the sensor assembly at or near to a centreline of the bore when the wheels are at the pre-set maximum outer diameter.

9. The device as claimed in claim 1, wherein the wheels are movably supported to be coupled to move together simultaneously so that the wheels lie on a substantially circular curve at the minimum outer diameter and at the pre-set maximum outer and at any diameter in between.

10. The device as claimed in claim 1, wherein each wheel is moveably supported to move between the minimum outer diameter and the pre-set maximum outer diameter independently of the other wheels.

11. The device as claimed in claim 1, wherein the device comprises:

a frame adapted to attach the device to the sensor assembly;

a plurality of arm assemblies azimuthally spaced apart around the frame, each arm assembly comprising a said wheel and configured to move the wheel between the minimum outer diameter and the maximum outer diameter, the one or more spring elements biasing the arm assemblies radially outwards.

12. The device as claimed in claim 11, wherein each arm assembly comprises:

a support member adapted to move axially along the frame;

a first arm pivotally attached to the frame via a first pivot joint;

a second arm pivotally attached to the support member via a second pivot joint;

the first and second arms pivotally attached together by a third pivot joint, the wheel mounted at or adjacent to the third pivot joint;

wherein axial movement of the support member away from and towards the wheels moves the wheels between the minimum outer diameter and the pre-set maximum outer diameter of the device by pivoting of the first and second arms about the first and second pivot joints.

13. The device as claimed in claim 11, wherein the adjustable stop mechanism comprises a stop component configured to be adjustable to a set position relative to the frame, in the set position the stop component setting the maximum outer diameter.

14. The device as claimed in claim 13, wherein the device comprises:

a support member adapted to move axially along the frame;

wherein the arm assemblies are coupled to the support member so that axial movement of the support member away from and towards the wheels moves the wheels between the minimum outer diameter and the pre-set maximum outer diameter; and in the set position the stop component engages one or more said arm assemblies or the support member to prevent the arm assemblies moving radially outwards.

15. The device as claimed in claim 13, wherein the adjustable stop mechanism comprises a threaded engagement between the stop component and the frame, wherein relative rotation between the stop component and the frame adjusts a position of the stop component axially along the frame.

16. The device as claimed in claim 11, wherein each arm assembly comprises an arm, an inner end of the arm pivotally attached to the frame, and the wheel mounted to the arm adjacent to an outer end of the arm;

wherein the arm moves the wheel between the minimum outer diameter and the pre-set maximum outer diameter of the device by pivoting of the arm about the pivot joint; and wherein an outer end of the arm is uncoupled from the other said arms.

17. A method for transporting a sensor assembly along a bore, the method comprising:

providing a plurality of transportation devices, each device comprising:

a plurality of wheels azimuthally spaced apart around a longitudinal axis of the device, each wheel presenting a radial extremity of the device, the wheels moveably supported to move between a minimum outer diameter of the device and a maximum outer diameter of the device, and one or more spring elements to bias the wheels radially outwards;

configuring each device so that the maximum outer diameter of the device is less than the diameter of the bore, and so that the one or more spring elements are preloaded to provide a radial force to the wheels when at the maximum outer diameter sufficient to support the sensor assembly as it traverses along the bore and so that the wheels carry the sensor assembly along the bore while contacting on one side of the bore only, or without contacting an opposite side of the bore;

attaching the plurality of transportation devices to the sensor assembly, including spacing the devices axially apart along a length of the sensor assembly; and lowering the sensor assembly and the plurality of transportation devices down the bore on a wireline to descend down the bore under gravity.

18. The method as claimed in claim 17, wherein each device comprises an adjustable stop mechanism configured to pre-set the maximum outer diameter of the device within a range of maximum outer diameters so that the device is configurable for use in a pre-determined range of bore diameters, and the method comprises:

adjusting the adjustable stop mechanism of each device so that the pre-set maximum outer diameter of each device is slightly smaller than the diameter of the bore.

19. The method as claimed in claim 18, wherein the method is for transporting the sensor assembly along a pipe or cased bore and the method comprises adjusting the adjustable stop mechanism of each device so that the pre-set maximum outer diameter of each device is approximately 0.1 inch smaller than the diameter of the bore.

20. The method as claimed in claim 19, wherein the method comprises placing a section of pipe the same size or smaller than the bore over each device and adjusting the mechanical stop mechanism until the pre-set maximum outer diameter is slightly less than the ID of the pipe.

* * * * *